US010669720B1

(12) United States Patent
Pavlansky et al.

(10) Patent No.: US 10,669,720 B1
(45) Date of Patent: Jun. 2, 2020

(54) STACKABLE CLOSURE STRIP

(71) Applicant: Hibco Plastics, Inc., Yadkinville, NC (US)

(72) Inventors: Mark Pavlansky, Yadkinville, NC (US); Keith Pavlansky, Yadkinville, NC (US)

(73) Assignee: Hibco Plastics, Inc., Yadkinville, NC (US)

( * ) Notice: Subject to any disclaimer, the term of this patent is extended or adjusted under 35 U.S.C. 154(b) by 0 days.

(21) Appl. No.: 15/891,452

(22) Filed: Feb. 8, 2018

Related U.S. Application Data

(60) Provisional application No. 62/457,334, filed on Feb. 10, 2017.

(51) Int. Cl.

| | |
|---|---|
| ***E04D 13/15*** | (2006.01) |
| ***E04B 1/66*** | (2006.01) |
| ***E04D 13/00*** | (2006.01) |
| ***E04D 3/30*** | (2006.01) |

(52) U.S. Cl.
CPC ..... *E04D 13/15* (2013.01); *E04B 1/66* (2013.01); *E04D 3/30* (2013.01); *E04D 13/004* (2013.01)

(58) Field of Classification Search
CPC ..... E04D 13/15; E04D 3/30; E04B 1/66
See application file for complete search history.

(56) References Cited

U.S. PATENT DOCUMENTS

| | | | | |
|---|---|---|---|---|
| 429,937 | A * | 6/1890 | Mitchell | C04B 37/026 428/594 |
| 4,017,090 | A * | 4/1977 | Cohen | E04C 2/322 277/631 |
| 4,024,685 | A | 5/1977 | Aarons | 52/278 |
| 4,351,870 | A | 9/1982 | English, Jr. | 428/174 |
| 4,401,705 | A * | 8/1983 | Ewert | E04D 3/3607 428/131 |
| 4,876,950 | A | 10/1989 | Rudeen | 98/42.23 |
| 4,924,761 | A | 5/1990 | MacLeod et al. | 98/42.21 |
| 5,146,646 | A | 9/1992 | Langford et al. | 15/210.1 |
| 5,252,657 | A | 10/1993 | Frankel et al. | 524/460 |
| 5,288,269 | A | 2/1994 | Hansen | 454/365 |
| 5,425,672 | A | 6/1995 | Rotter | 454/365 |
| 5,458,538 | A | 10/1995 | MacLeod et al. | 454/365 |
| 5,540,022 | A | 7/1996 | Morris | 52/309.8 |
| 5,548,538 | A | 8/1996 | Grace et al. | 364/571.04 |
| 5,561,953 | A | 10/1996 | Rotter | 52/198 |
| 5,651,734 | A | 7/1997 | Morris | 454/365 |
| 5,673,521 | A | 10/1997 | Coulton et al. | 52/199 |
| 5,705,252 | A | 1/1998 | Lea et al. | 428/133 |
| 5,706,618 | A | 1/1998 | Pratt | 52/199 |
| 5,772,502 | A | 6/1998 | Smith | 454/365 |
| 5,784,845 | A | 7/1998 | Imeokparia et al. | 52/408 |
| 5,813,176 | A | 9/1998 | Tzeng et al. | 52/198 |

(Continued)

*Primary Examiner* — Paola Agudelo
(74) *Attorney, Agent, or Firm* — MacCord Mason PLLC

(57) ABSTRACT

Closure strip devices, systems, kits, assemblies and methods are shown and described. A closure strip for a building having a metal roof may include a body, a top surface on one side of the body, a raised shelf formed in the body on the top surface, and a bottom surface having a hollow portion. A second closure strip may be accepted and recessed into the hollow portion of the first closure strip. The raised shelf may include breaks along a length of the body between separated raised portions. There may be depressions in each of the separated raised portions.

20 Claims, 23 Drawing Sheets

(56) References Cited

U.S. PATENT DOCUMENTS 5,826,383 A * 10/1998 Garrison ..... E04D 13/174 52/198
5,934,995 A 8/1999 Morris et al. ..... 454/365
5,979,131 A 11/1999 Remmele et al. ..... 52/309.9
6,079,166 A * 6/2000 Mason ..... E04D 13/174 454/365
6,177,024 B1 1/2001 Sandoval et al. ..... 252/62
6,228,476 B1 5/2001 Bogrett et al. ..... 428/306.6
6,343,985 B1 2/2002 Smith ..... 454/365
6,458,029 B2 10/2002 Morris ..... 454/365
D465,992 S * 11/2002 Sarig ..... E04D 13/1656 D8/354
6,944,997 B2 * 9/2005 Verkamp ..... E04D 3/3607 428/158
6,981,916 B2 1/2006 Coulton ..... 454/365
7,278,246 B2 * 10/2007 Nahmias ..... E04D 3/3607 206/321
8,302,352 B2 * 11/2012 Bahn ..... E04D 13/174 52/199
8,403,593 B2 3/2013 Dagesse ..... 404/41
8,512,841 B2 * 8/2013 Ford ..... C09J 7/29 428/40.1
8,852,639 B2 10/2014 MacKay ..... 424/486
9,151,059 B2 10/2015 Pavlansky et al. ..... 13/174
9,234,353 B2 1/2016 Pavlansky et al. ..... 13/76
9,334,655 B2 * 5/2016 Polumbus ..... E04D 13/174
2001/0032421 A1 10/2001 Rotter ..... 52/198
2002/0193065 A1 12/2002 Morris et al. ..... 454/365
2004/0093812 A1 5/2004 Rotter ..... 52/199
2004/0159054 A1 * 8/2004 Adriaansen ..... E04C 2/543 52/81.1
2005/0090197 A1 4/2005 Coulton ..... 454/365
2005/0126088 A1 6/2005 Rottr ..... 52/198
2005/0241248 A1 11/2005 Ridenour ..... 52/198
2007/0054612 A1 3/2007 Ehrman et al. ..... 454/365
2010/0018137 A1 1/2010 Polumbus et al. ..... 52/199
2012/0047828 A1 3/2012 Bahn ..... 52/199
2014/0165481 A1 * 6/2014 Pavlansky ..... E04D 13/174 52/198
2014/0223837 A1 8/2014 Pavlansky et al. ..... 52/12
2016/0060872 A1 3/2016 Pavlansky et al. ..... 13/174

* cited by examiner

STACKABLE CLOSURE STRIP

FIELD OF THE TECHNOLOGY

The present disclosure relates generally to a stackable closure strip, and more particularly to improved closure strip, systems, methods, and assemblies for preventing the ingress of foreign contaminants, such as, by way of example, insects, birds, wind driven precipitation and/or noise, from openings along the contour of metal roofing.

BACKGROUND

Metal roofing has become an accepted material that provides a high quality and long lasting roof. While shingles typically have been the most common type of roofing cover, metal roofing has become increasingly attractive in recent years. In particular, metal buildings and metal roofing have provided a very cost efficient alternative for construction projects in the face of rising construction costs.

Roofing profiles for projects having metal roofing may have gaps and/or voids because of the roof support structure. For example, numerous manufacturers of metal roofing panels may provide a profile that is composed of a pattern of a major rib that is, for example, about ¾" tall, and that repeats in determined intervals, for example, every nine inches. Each manufacturer may have a slightly different pattern but this type of pattern is typically called a ¾" panel. In this example, the profile of the metal roof, when viewed from the end, leaves openings on the major ribs that might allow for the penetration by wind driven precipitation, or openings through which birds, insects and other creatures can gain entrance into a roofing system. Applicant has found that closing these gaps is desirable to prevent the intrusion of foreign debris, acoustic energy, and precipitation from gaining entrance to the roofing system.

Providing a cost effective and durable closure for the structure having metal roofing has been a challenge in the field. Historically, rubber materials including EPDM and vinyl nitrate have been used in the construction of metal buildings and roofing to prevent penetration of foreign debris, however, in the 1970's, it was discovered that polyethylene foam could perform as well as EPDM and vinyl nitrate products. Polyethylene foam worked because it was closed cell and lighter in weight (around 2 pounds per cubic foot), however, it has been shown to suffer from oxidation and premature aging problems. Crosslinked polyethylene was also tried because it did not appear to have the oxidation problems of linear polyethylene, however, crosslinked polyethylene is expensive and available in limited quantities due to high demand in other markets outside the construction arena. Additionally, Applicant realized that crosslinked polyethylene typically is not recyclable, does not contain ultraviolet stabilizer to extend product life, some included no fire retardant properties, and is, at times, subject to shrinkage problems at elevated temperatures that are not unusual to metal roof structures during warmer months, when roof temperatures can reach up to around 200 degrees F.

In addition to the closure pieces being cost prohibitive and lacking in durability, closure pieces on structures with metal roofing have traditionally required large amounts of storage space in warehouse facilities, with shipping costs for the bulky pieces adding disproportionally to product cost for the closure pieces, producing large amounts of material waste and including high production labor costs. With metal roofing installations varying dimensionally, large amounts of inventory are often held to accommodate the different metal panel profiles. With some conventional closure pieces being made of about 90% or greater air, such closure pieces take up significant storage, transportation and shipment space.

Therefore, Applicants desire alternative cost-effective and durable options for closing gaps formed on structures due to installation of metal roofing by way of an improved closure strip and improved closure strip systems, methods, and assemblies for preventing the ingress of foreign contaminants, such as, by way of example, insects, birds, wind driven precipitation and/or noise, from openings along the contour of the metal roofing. It is to these and other challenges that this disclosure is directed.

SUMMARY

In accordance with the present disclosure, closure strip devices, assemblies and methods are provided for sealing gaps in structures having metal roofing. This disclosure provides improved closure strip devices, assemblies and methods that are convenient, efficient, and more durable for the structure owner.

The present disclosure, in some embodiments, includes a thermoformed polyolefin profile, such as linear polyethylene, configured to fit in the gaps of any ¼" metal roofing panel profile while including a hollow shape to allow for efficient packaging, storage and distribution of a set of closure strips. Applicant realized that the structure of closure strip 10 will eliminate the need for up to and around 75% of the current levels of storage space, and up to and around 75% of the weight of conventional closure strips. The inventions of this disclosure allow for multiple closure strips 10 to interlock and/or interface and to be stacked on top of each other which significantly reduces the amount of space needed for storage or shipping of the finished product relative to conventional closure strips.

In one example, a closure strip for a building having a metal roof, may include a thermally formed body, a top surface on one side of the body, a first end and a second end at opposite ends of the body, a bottom surface on an opposite side of the body from the top surface, and a hollow portion 18 in the bottom surface.

The closure strip may be transparent/clear. The body of the closure strip may be transparent/clear. The body may be thermoformed. The body may be a thermoplastic resin. The thermoplastic resin may be polyvinyl chloride.

Other embodiments may include a closure strip system for a building having a metal roof, including: a first closure strip and a second closure strip included in a set of closure strips. The at least first and second closure strip may include a thermally formed body, a top surface on one side of the body, a first end and a second end at opposite ends of the body, a bottom surface on an opposite side of the body from the top surface, and a hollow portion in the bottom surface.

The closure strip, in some examples, is adapted to recess into a second closure strip. In one embodiment, a chamber is formed between the top surface of the first closure strip and the bottom surface of a second closure strip.

A top surface of the body may include a raised shelf. The hollow portion of a first closure strip may be configured to accept the raised shelf of a second closure strip. The closure strips may be recessed one within another to achieve greater than 10 recessed closure strips stacked per inch, in some examples.

Methods and systems for a closure strip according to the embodiments herein are also considered within the scope of this disclosure.

The above summary was intended to summarize certain embodiments of the present disclosure. Embodiments will be set forth in more detail in the figures and description of embodiments below. It will be apparent, however, that the description of embodiments is not intended to limit the present inventions, the scope of which should be properly determined by the appended claims.

BRIEF DESCRIPTION OF THE DRAWINGS

Embodiments of the disclosure will be better understood by a reading of the Description of Embodiments along with a review of the drawings, in which.

DESCRIPTION OF EMBODIMENTS

Figure 1:
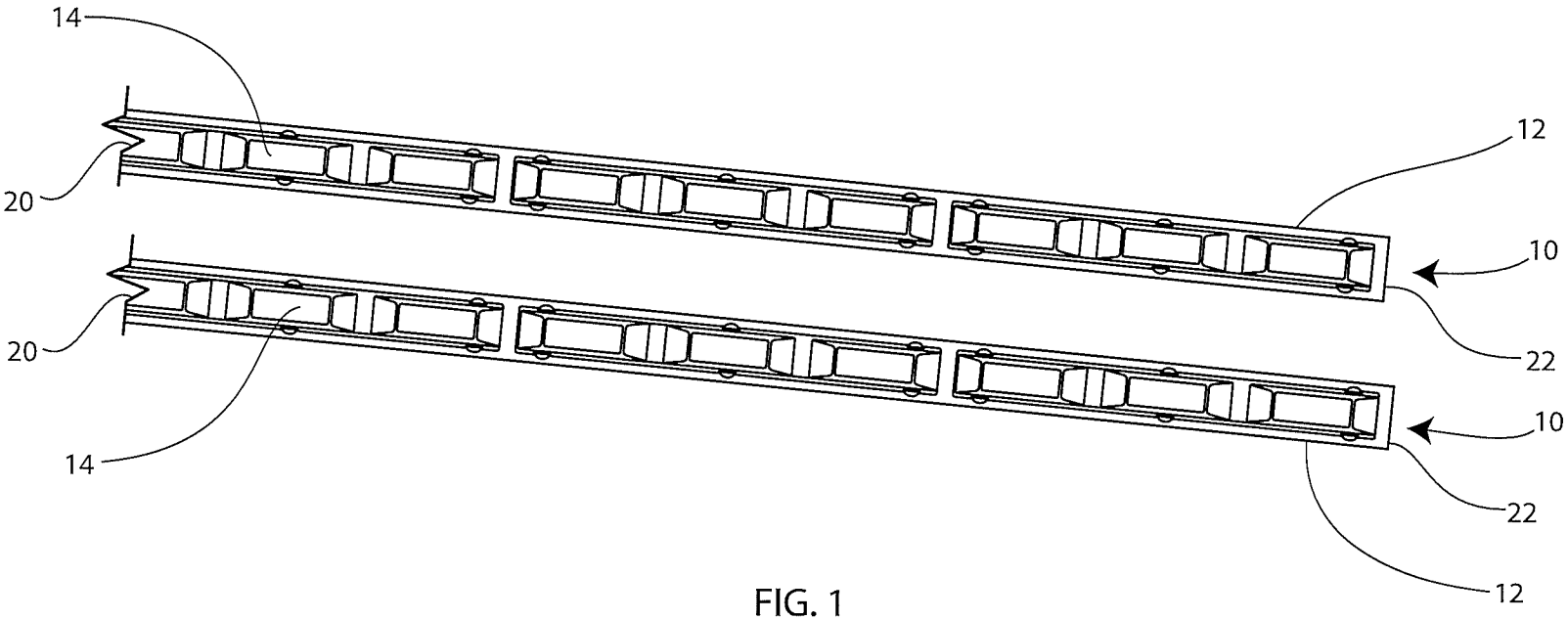
FIG. 1 is a top view of one example of a closure strip of the present disclosure.
Figure 2:
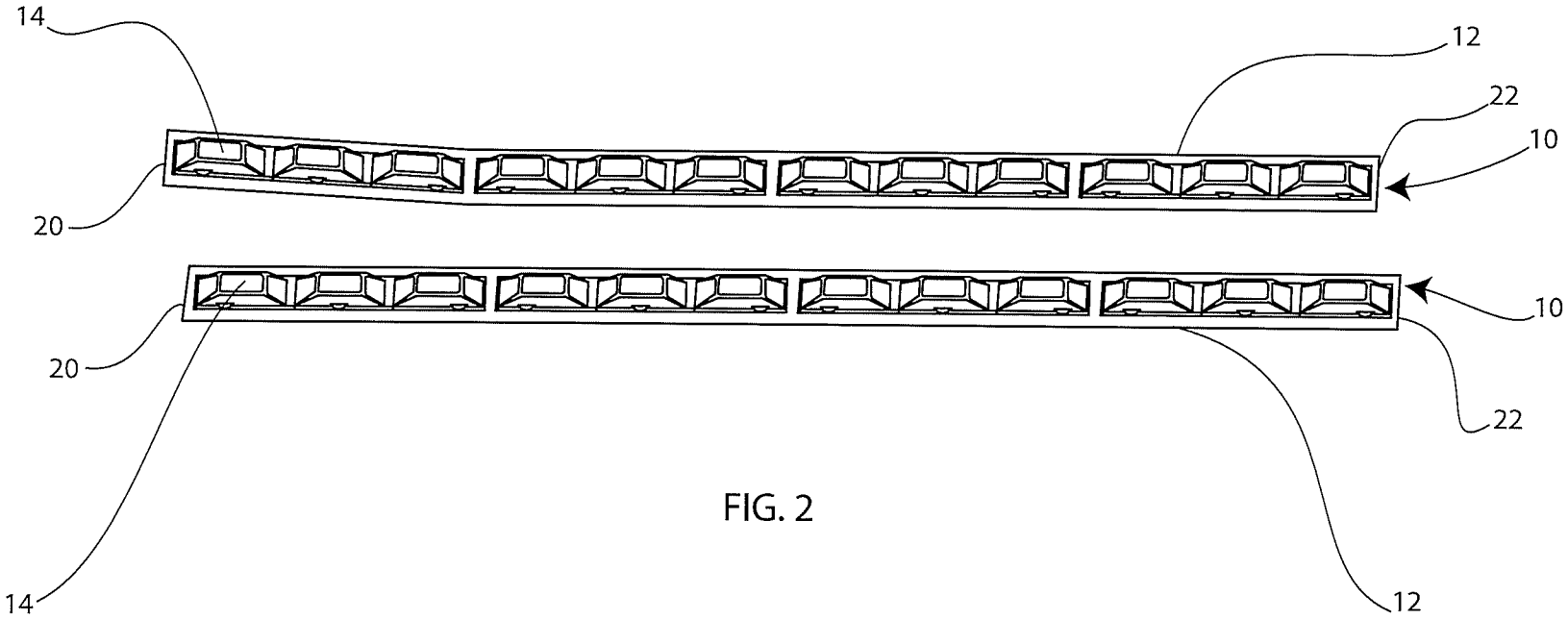
FIG. 2 is a bottom view of one embodiment of an improved closure strip according to the disclosure.
Figure 3:
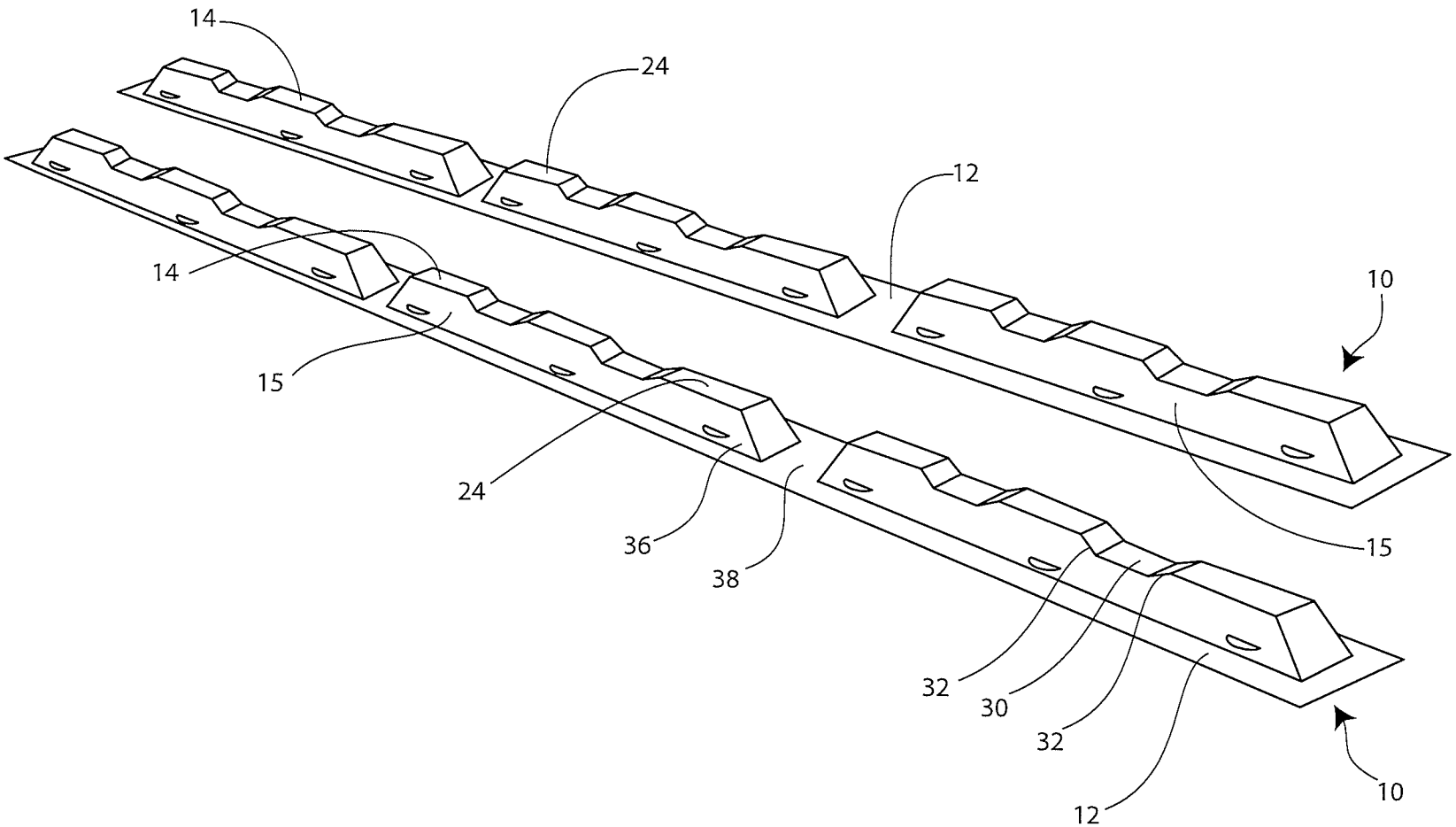
FIG. 3 is a perspective side view of one example of a closure strip according to the present disclosure.
Figure 4:
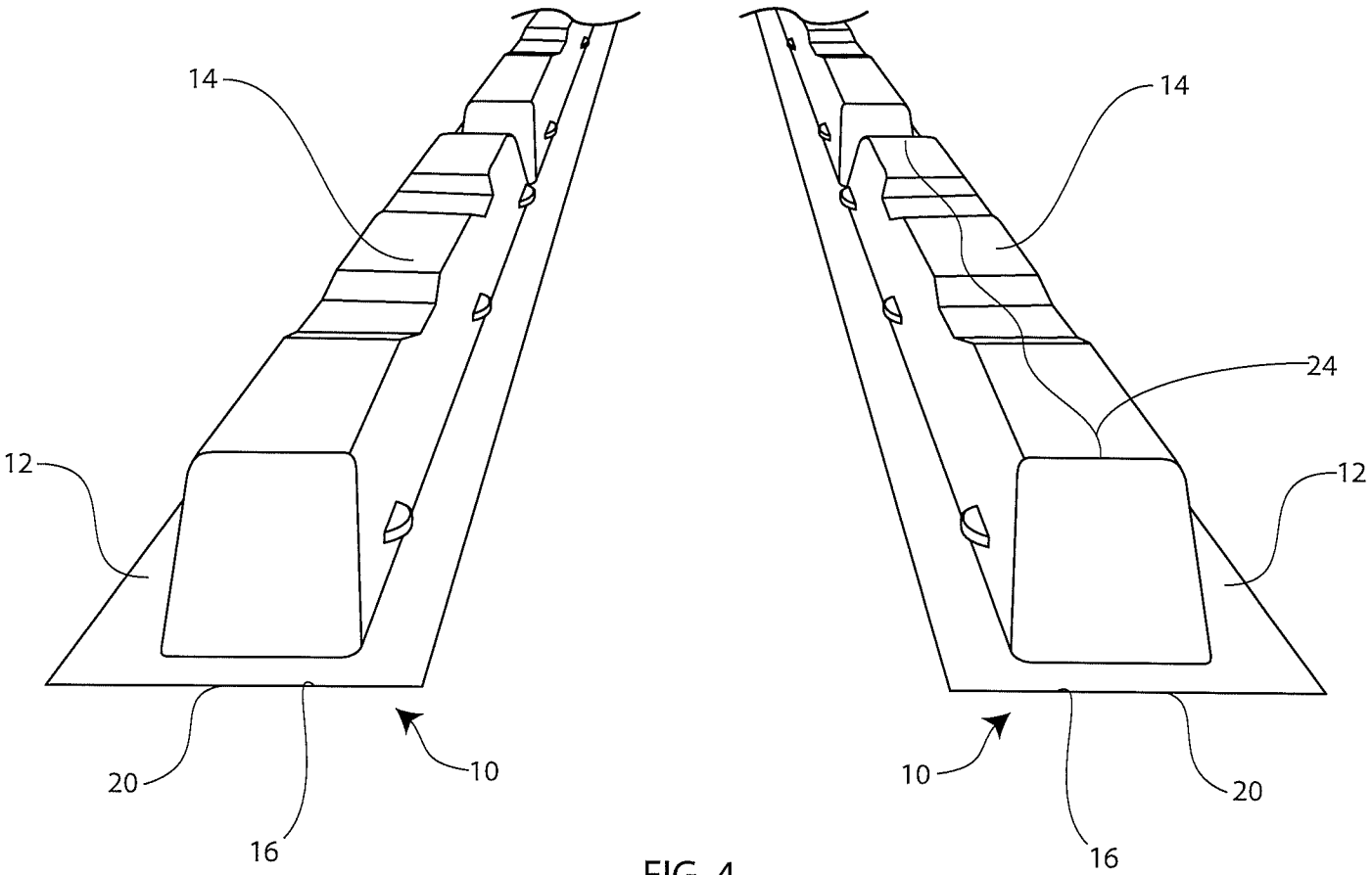
FIG. 4 is an end view of one example of a closure strip according to the present disclosure.
Figure 5:
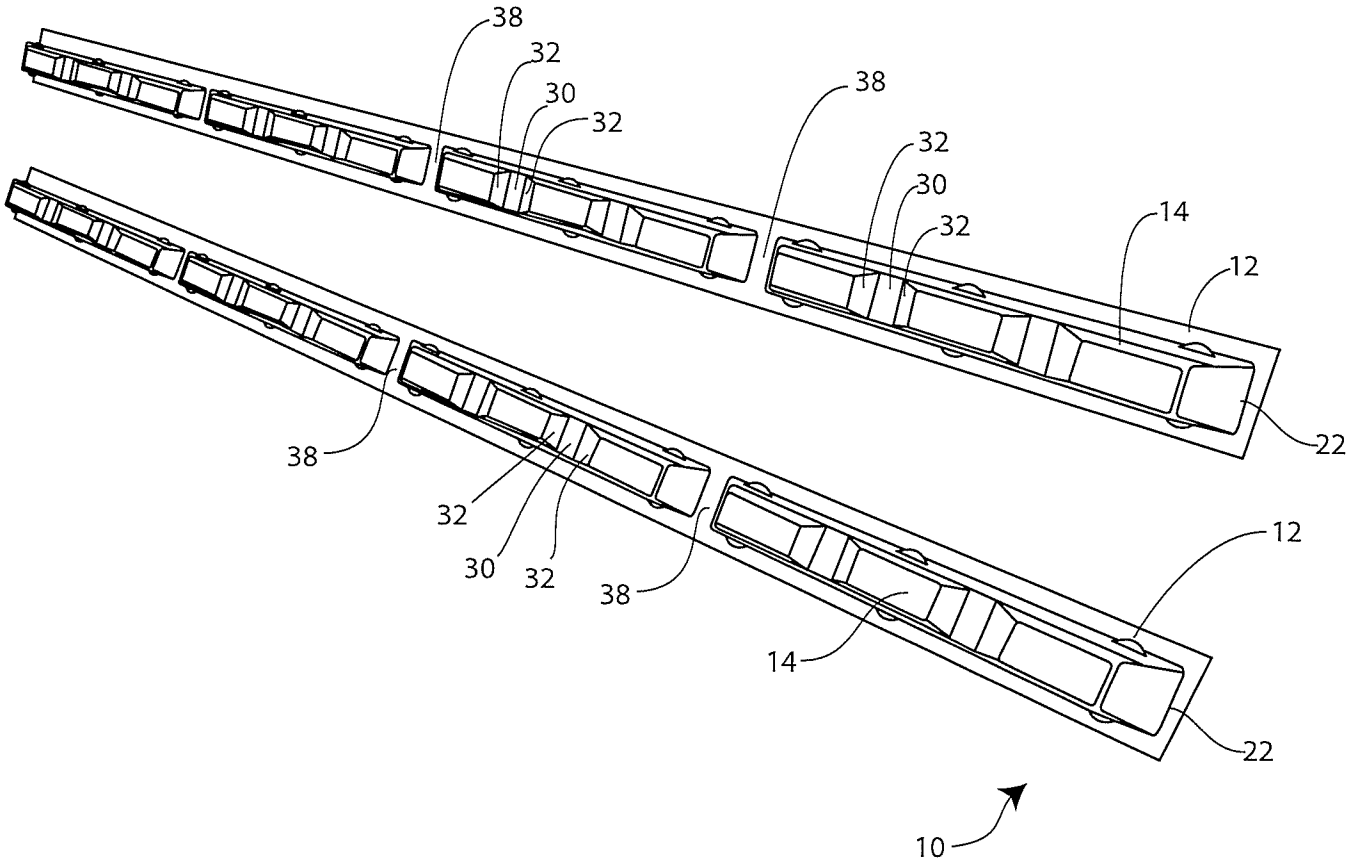
FIG. 5 is a perspective top view of one example of a closure strip according to the present disclosure.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general and FIGS. 1-5 in particular, it will be understood that the illustrations are for the purpose of describing embodiments of the disclosure and are not intended to limit the disclosure or any invention thereto. FIG. 1 introduces one example of a closure strip 10. The closure strip 10, for a building having a metal roof, may include a thermally formed body 12, a top surface on one side of the body 14, a first end 20 and a second end 22 at opposite ends of the body, a bottom surface 16 on an opposite side of the body from the top surface, and a hollow portion 18 in the bottom surface.

The top surface 14 may include an adhesive 24 on the top surface. The bottom surface may include an adhesive 44 on a surface of the hollow portion 18. By way of example, the adhesive may be an adhesive strip and/or an adhesive bead or series of beads. The adhesive may be, for example, a silicone adhesive.

The top surface 14 may include a raised shelf 15. The raised shelf 15 may include a series of breaks 38. The breaks 38 may separate the raised shelf 15 into a series of shelf sections. The breaks 38 may include shoulders 36 on each side of the break 38. The shoulders 36 may be angled inwardly toward each other from a top face raised shelf 15 to a bottom face of the break 38. The shoulders 36 may take on other shapes, by way of example, the shoulders 36 may be curved. The raised shelf 15 may, in some examples, be considered a series of major ribs, separated by breaks.

The raised shelf 15 may also include a series of depressions 30. The depressions 30 may include shoulders 32. Shoulders 32 may be angled inwardly toward each other from a top face of raised shelf 15 to a bottom face of depression 30. The shoulders 32 may take on other shapes, by way of example, the shoulders 32 may be curved. The bottom face of depression 30, in some examples, may be closer to the top surface of the raised shelf 15 than the bottom face of the break 38.

In some embodiments, the raised shelf 15 may include two or more depressions 30 between each break 38. They depressions 30 and breaks 38 may be configured to fit in the gaps of any metal roofing, for example, a ¾" metal roofing panel profile The body 12 may have a thermoformed polyolefin profile, by way of example, such as linear polyethylene. Some embodiments may include a thin sheet of plastic such as a linear low density polyethylene with a 0.02"-0.06" thickness that can be heated and therefore softened, then placed over a mold that corresponds to a shape of a metal roofing profile. The thin sheet of plastic takes the shape of the mold, then it cools, and can be cut and used as a closure strip for metal roofing.

The body 10 may be a thermally formed PVC closure strip. The thermally formed closure strip 10 may be manufactured by heating a thin sheet of plastic, making it soft, pressing the soft heated plastic over the top of a mold, and forcing the plastic to conform to the three dimensional shape of the tooling or mold and then cooled retaining the shape of the three dimensional mold. By way of example, a thermally formed closure strip 10 may be made of Klockner Pentatplast Pentaform-TH M 280/14.

In some examples, the thermoforming process may include a thin plastic sheet (4 mil for example) which is heated using an oven or another suitable source of heating elements. The material is subjected to heat, but is not heated all the way up to the melting point, to the forming temperature. The thin plastic sheet softens at the forming temperature, and is then placed into a mold or a tool. Typically, a vacuum is used to draw the thin plastic sheet completely over the mold or tool, and then the plastic cools and takes the shape of the tool it was formed over.

Figure 6A:
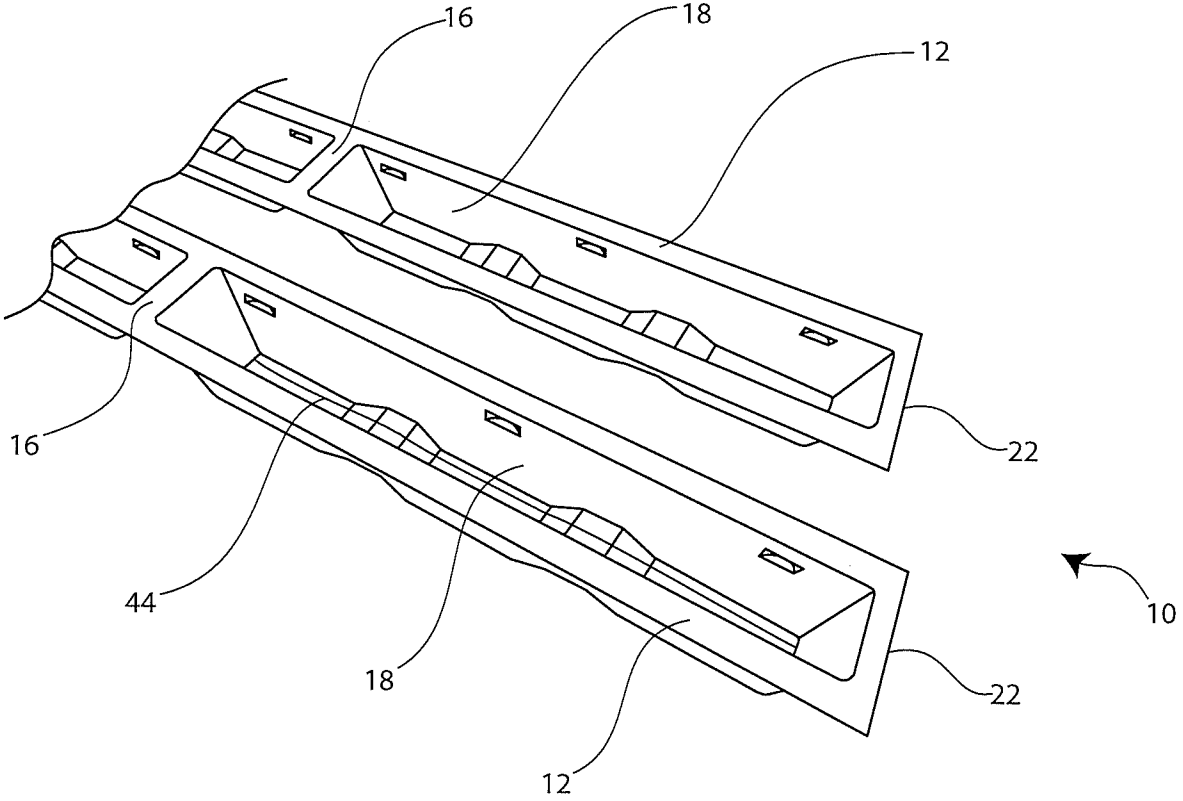
FIGS. 6A-6F are various close-up views of examples of a closure strip according to the present disclosure.
Figure 6B:
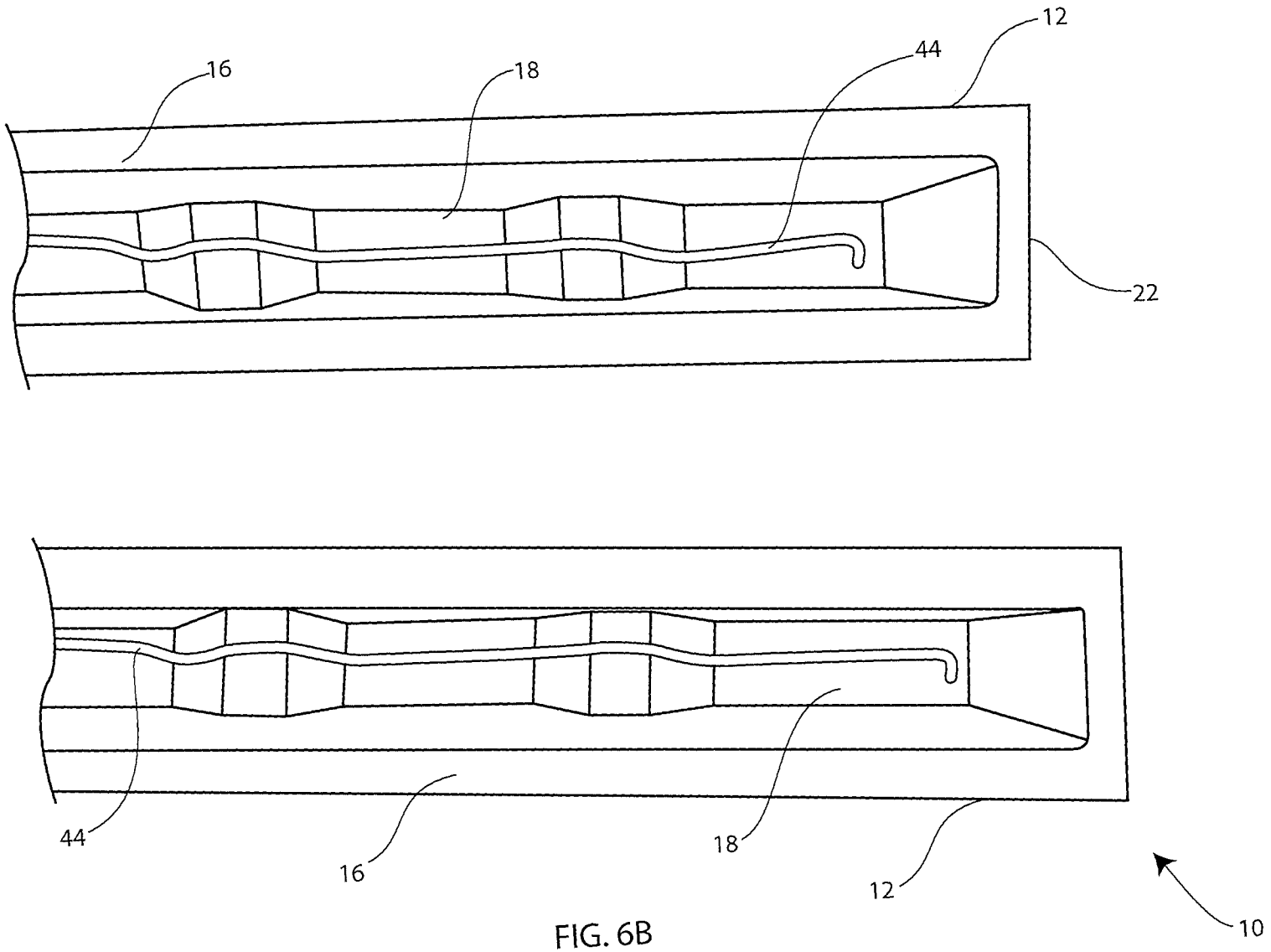
Figure 6C:
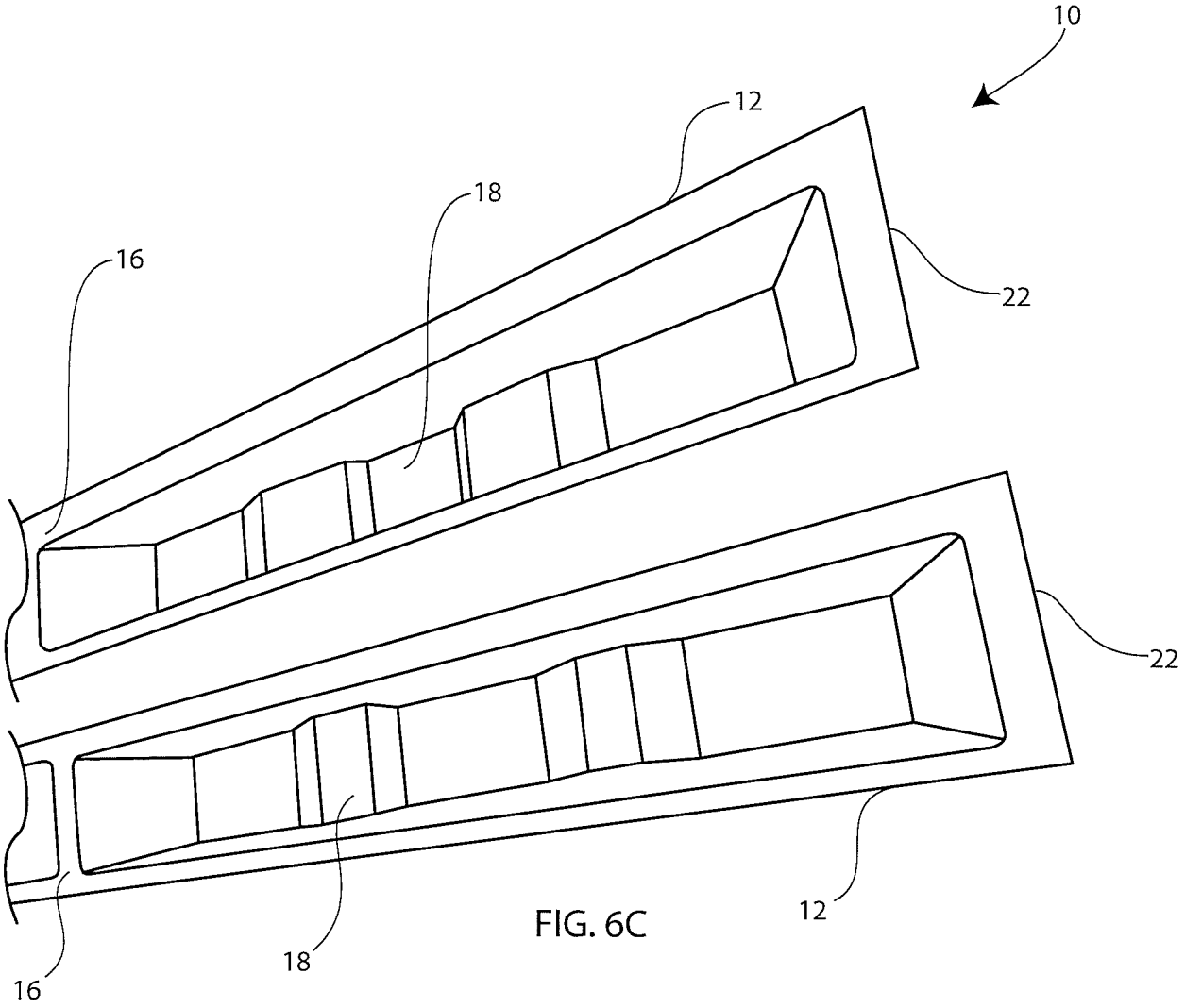

FIGS. 6A-6C show a bottom surface 16 of a closure strip 10. Bottom surface 16 may include a hollow portion 18. The hollow portion 18 of a first closure strip may be configured to accept a raised shelf 15 or major rib of a second closure strip 10 recessed into the hollow portion 18 of the first closure strip. First and second closure strips, and third and fourth, etc, may be configured to be assembled end to end.

Figure 6D:
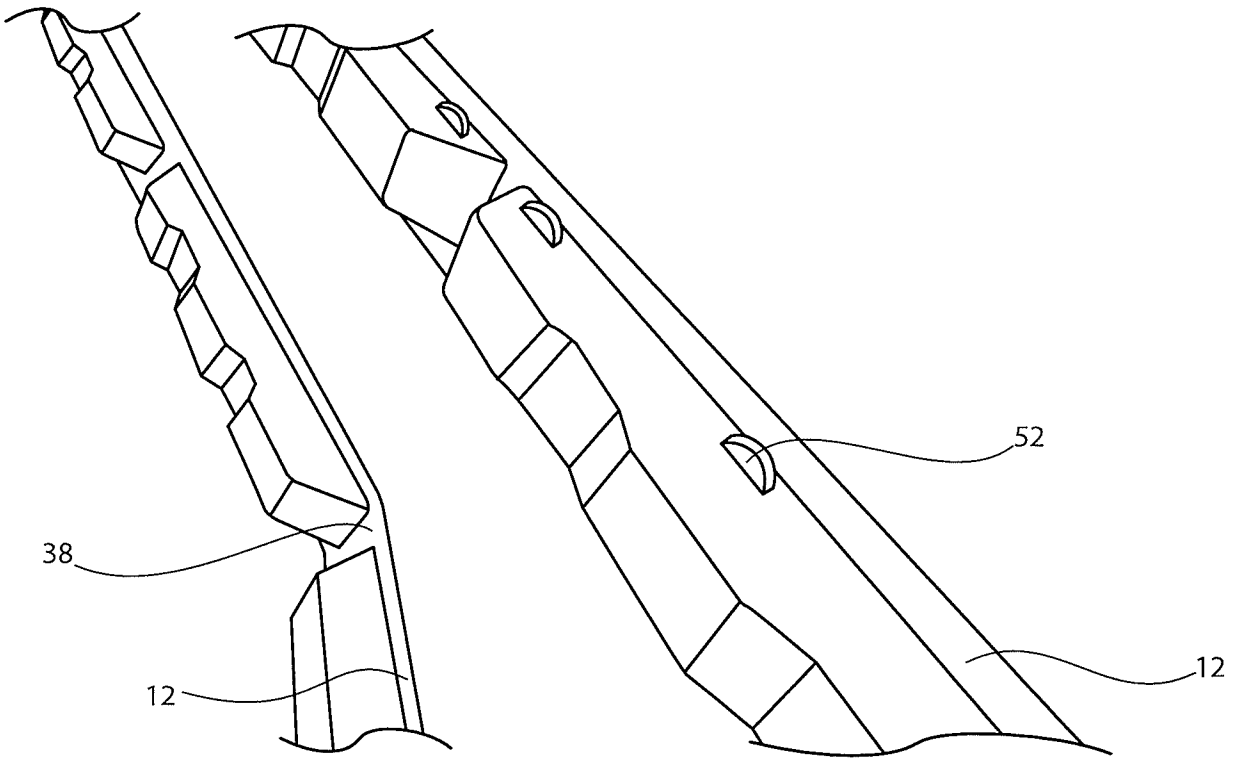
Figure 6E:
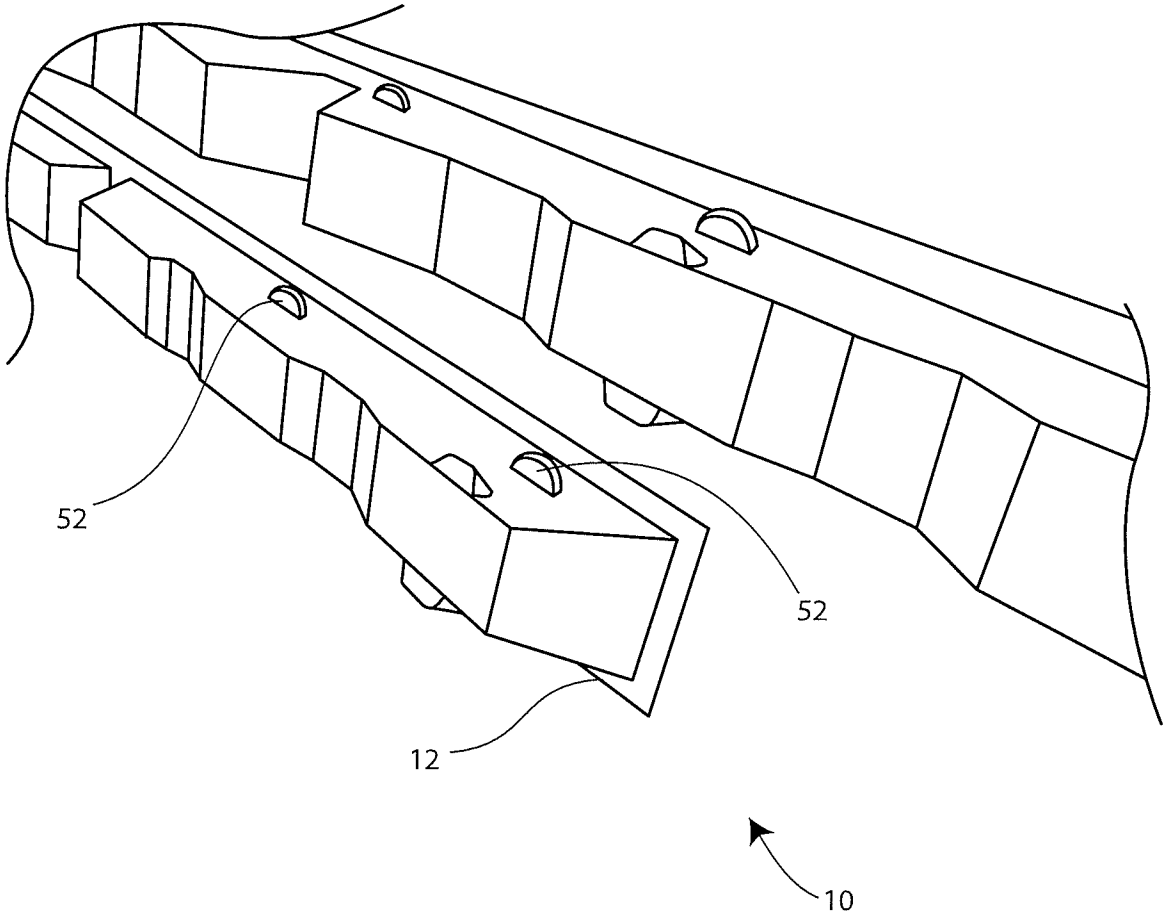
Figure 6F:
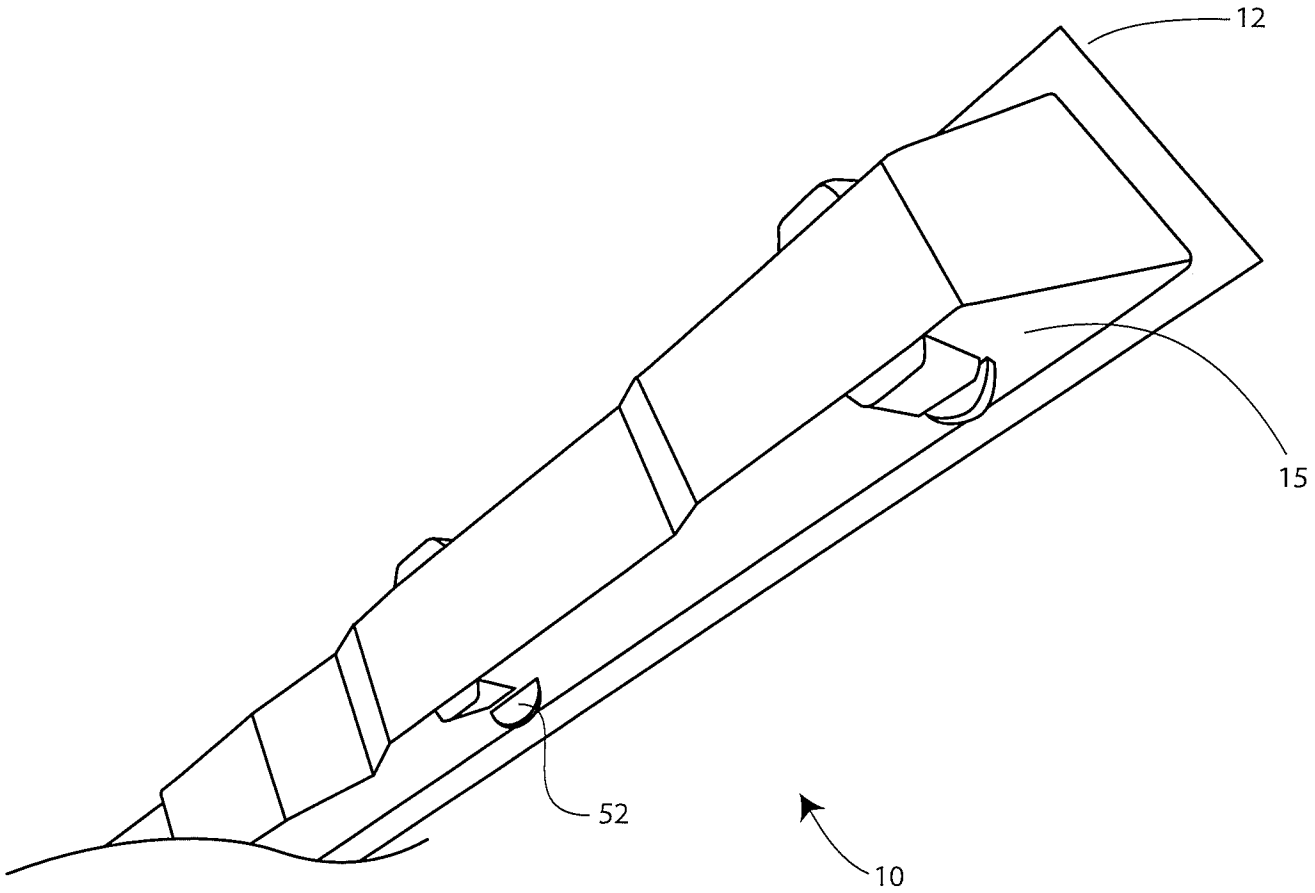
Figure 7A:
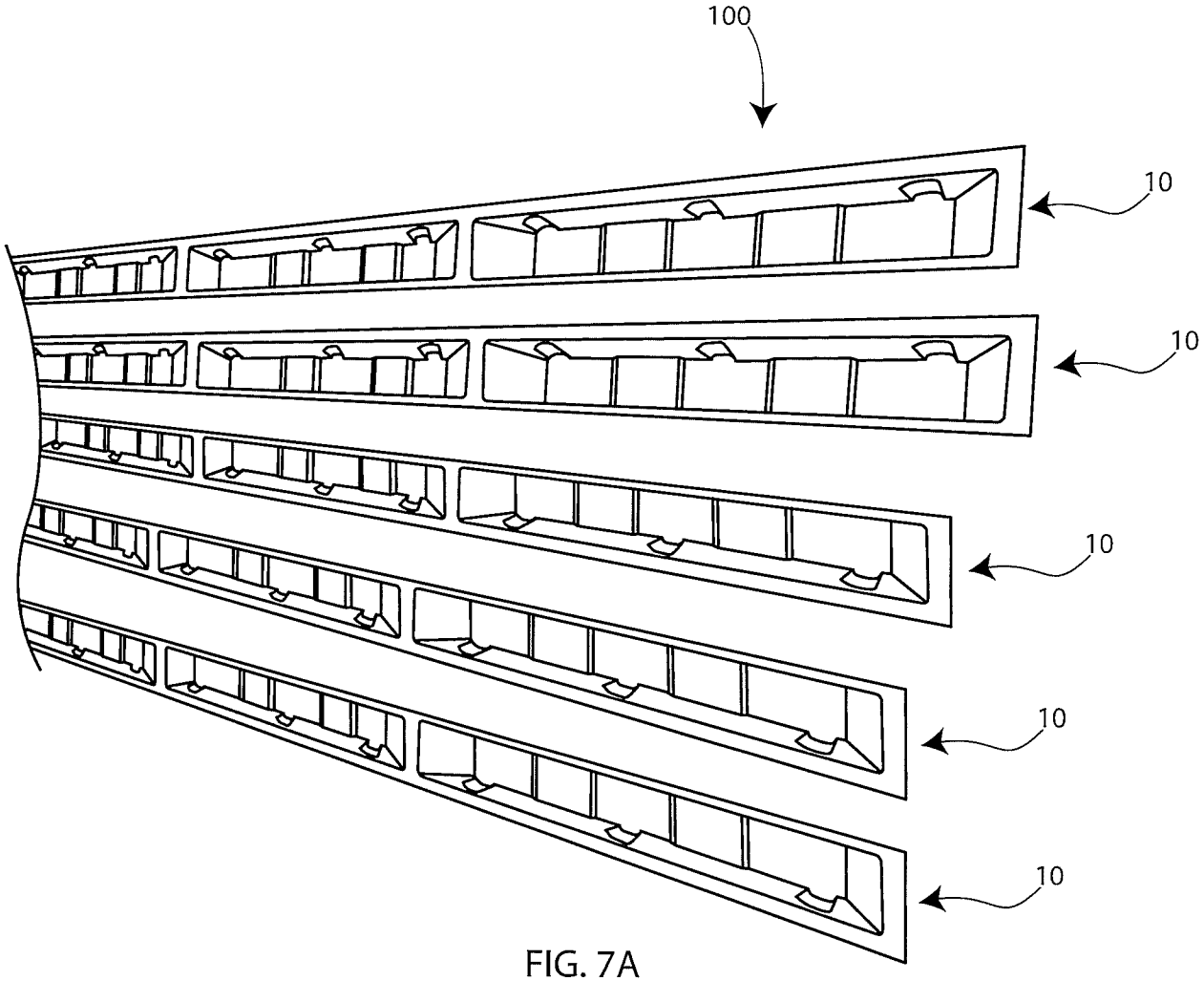
FIGS. 7A-7E are various views of a set of closure strips in a closure strip system according to the present disclosure.
Figure 7B:
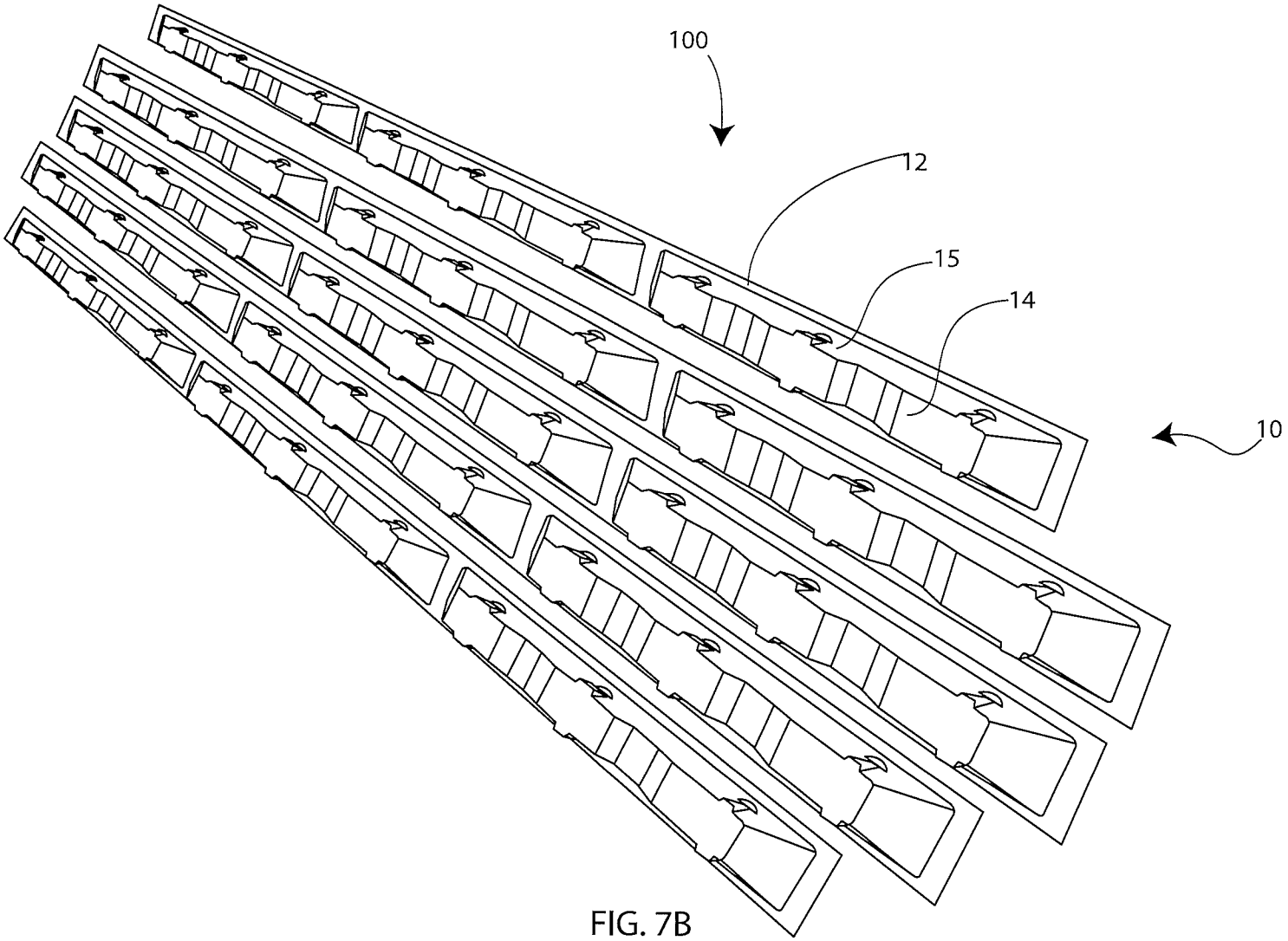
Figure 7C:
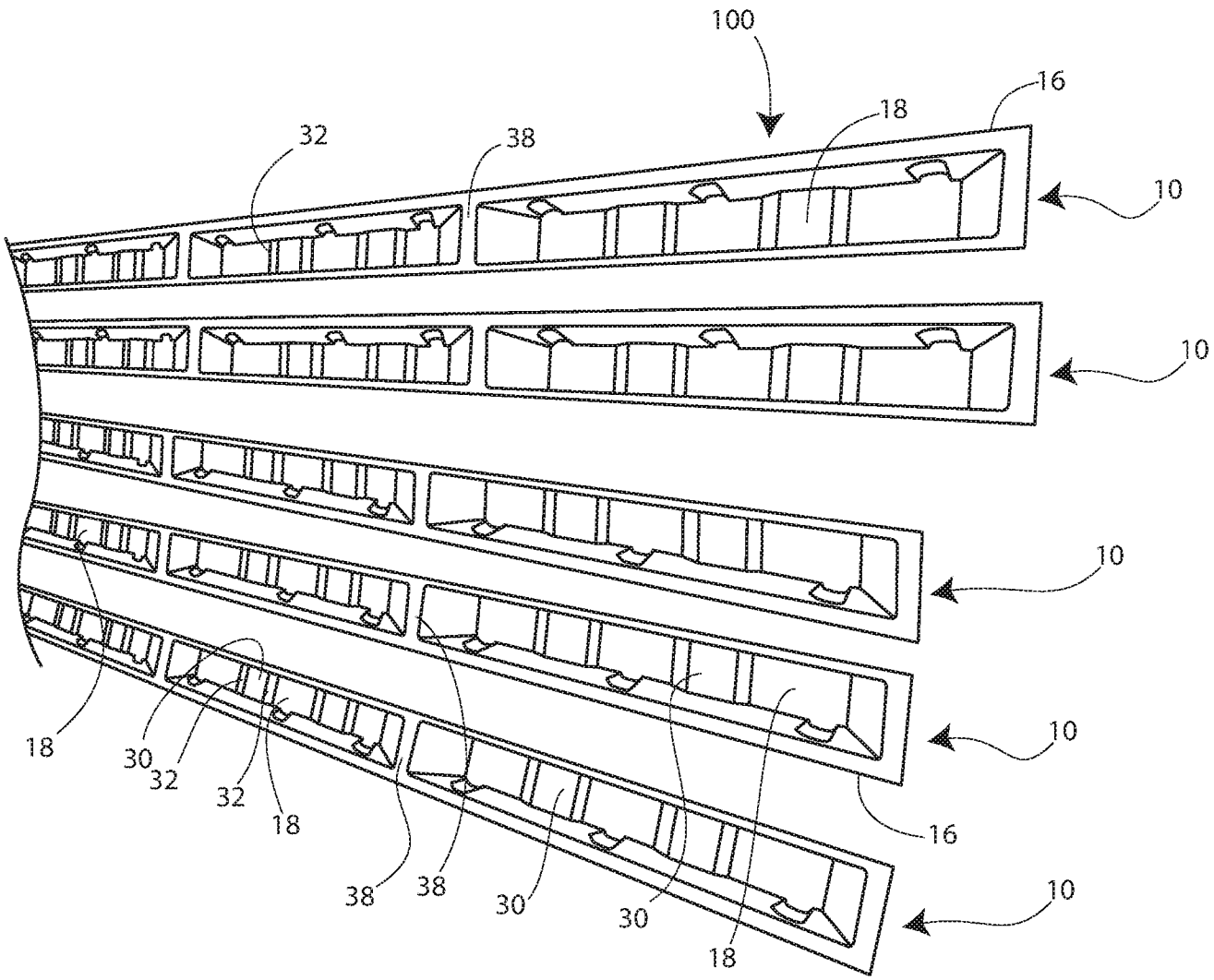
Figure 7D:
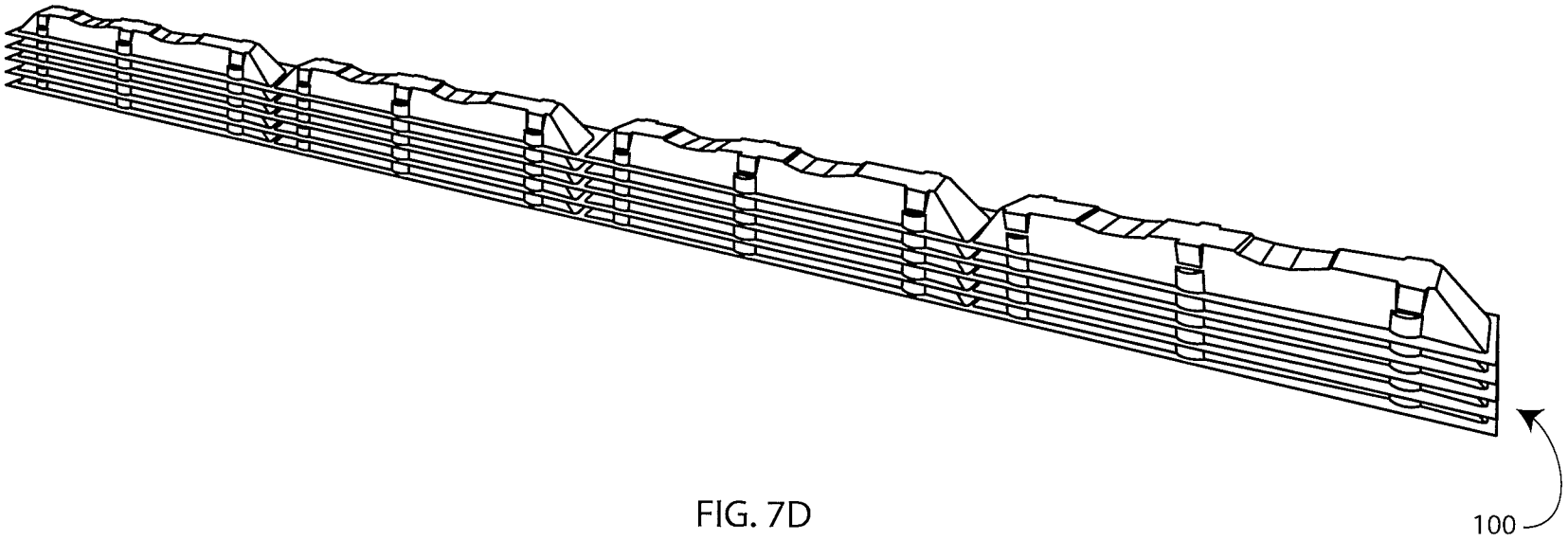
Figure 7E:
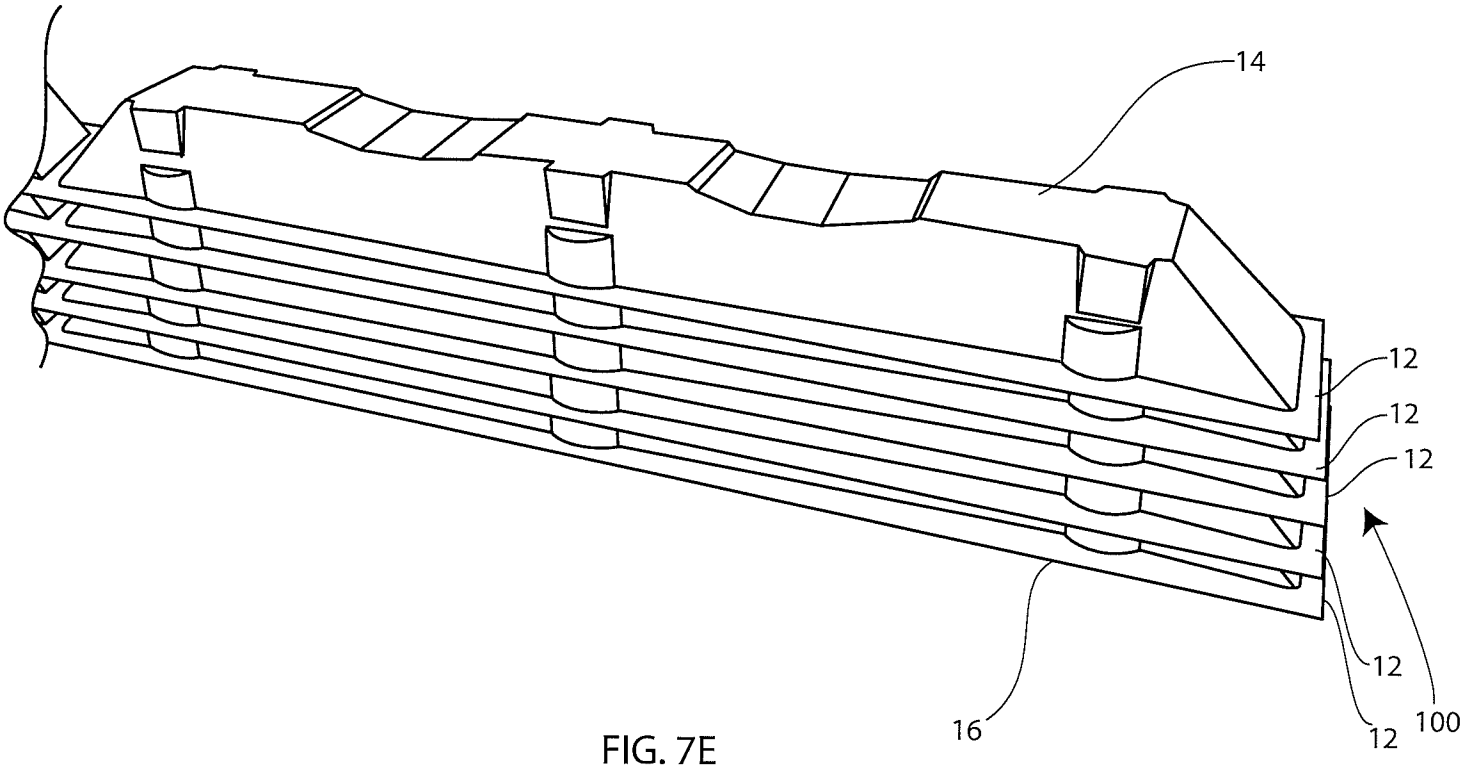
Figure 8A:
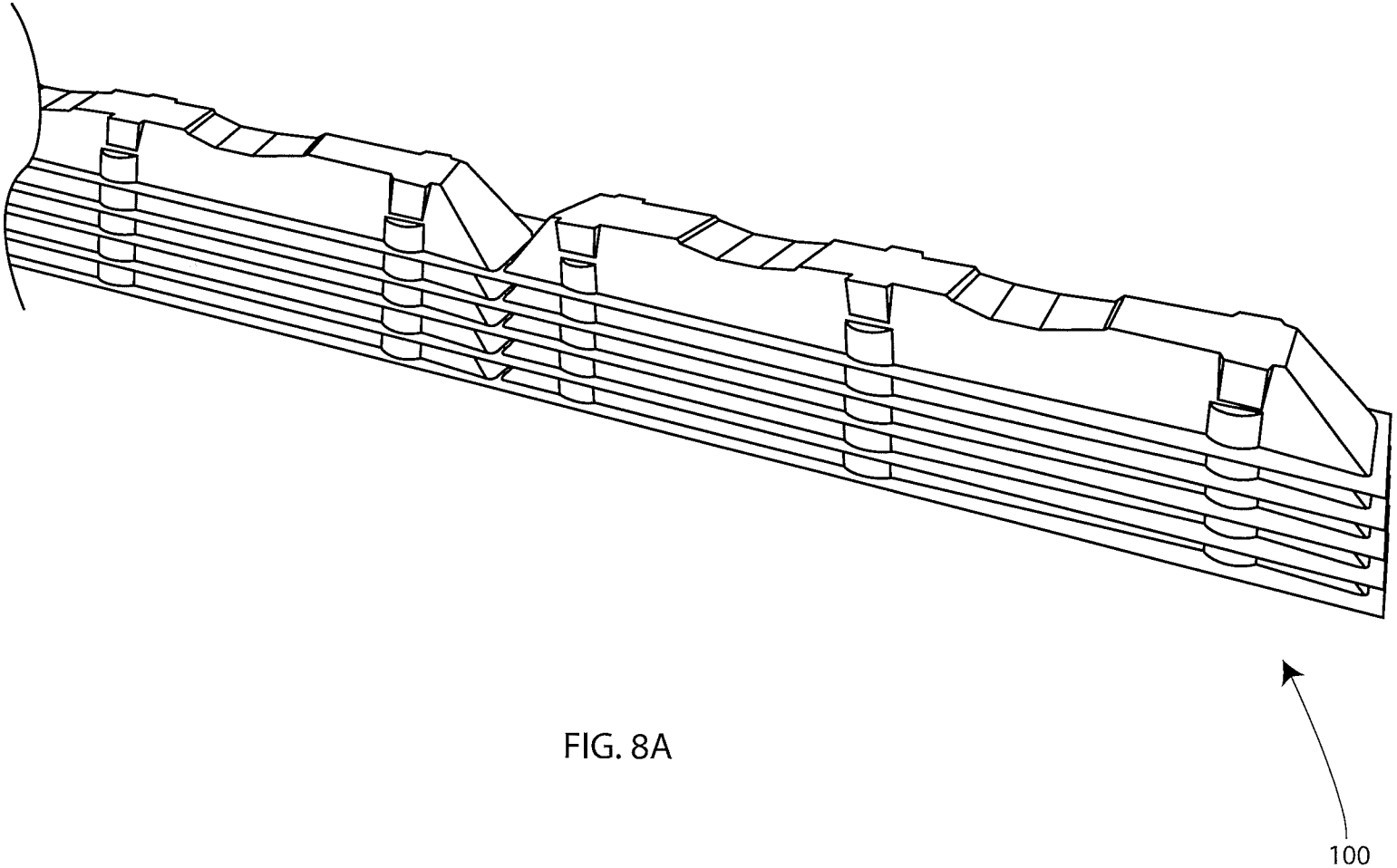
FIGS. 8A-8D are various views of a grouping of stacked closure strips according to the present disclosure.
Figure 8B:
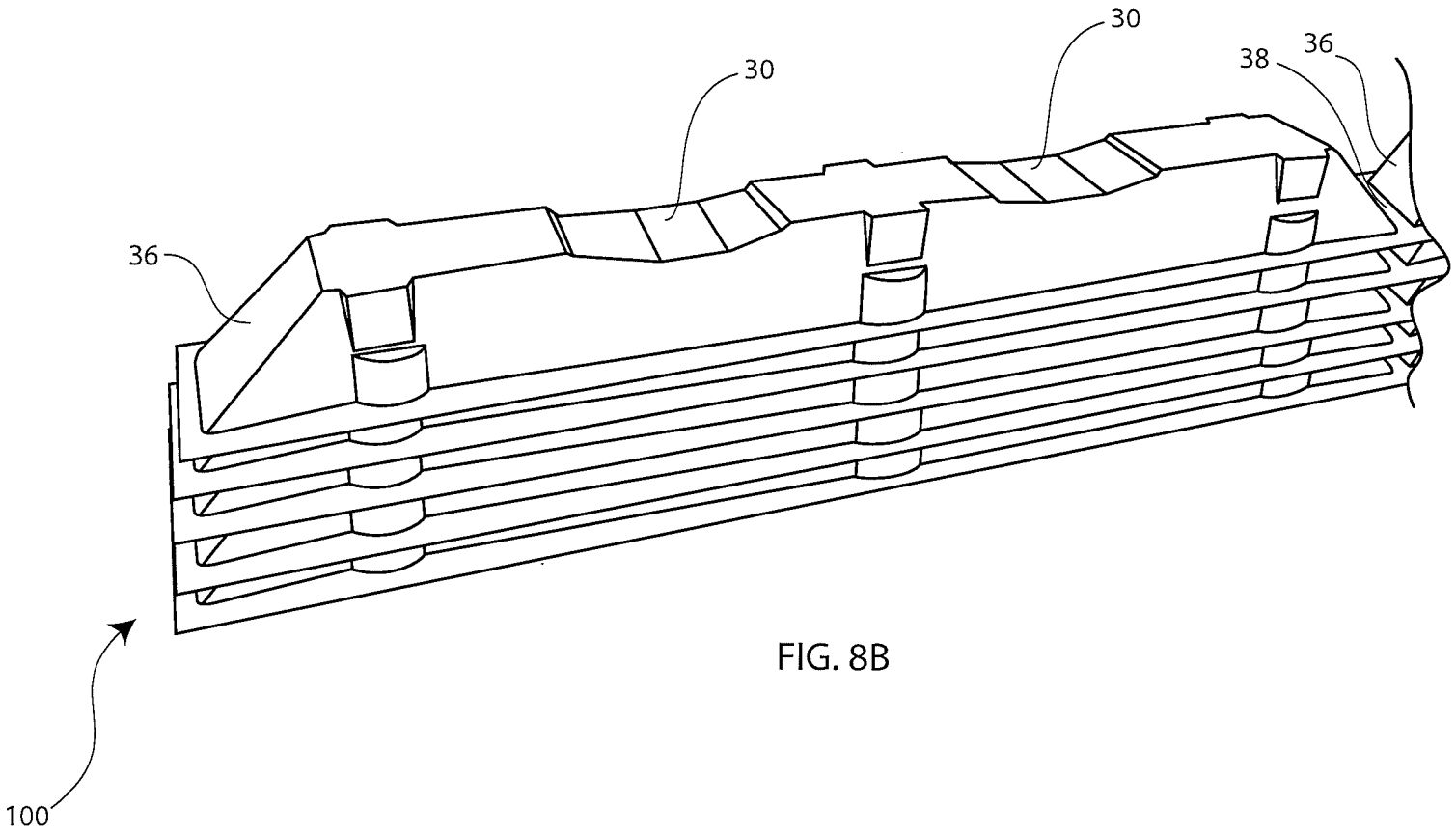
Figure 8C:
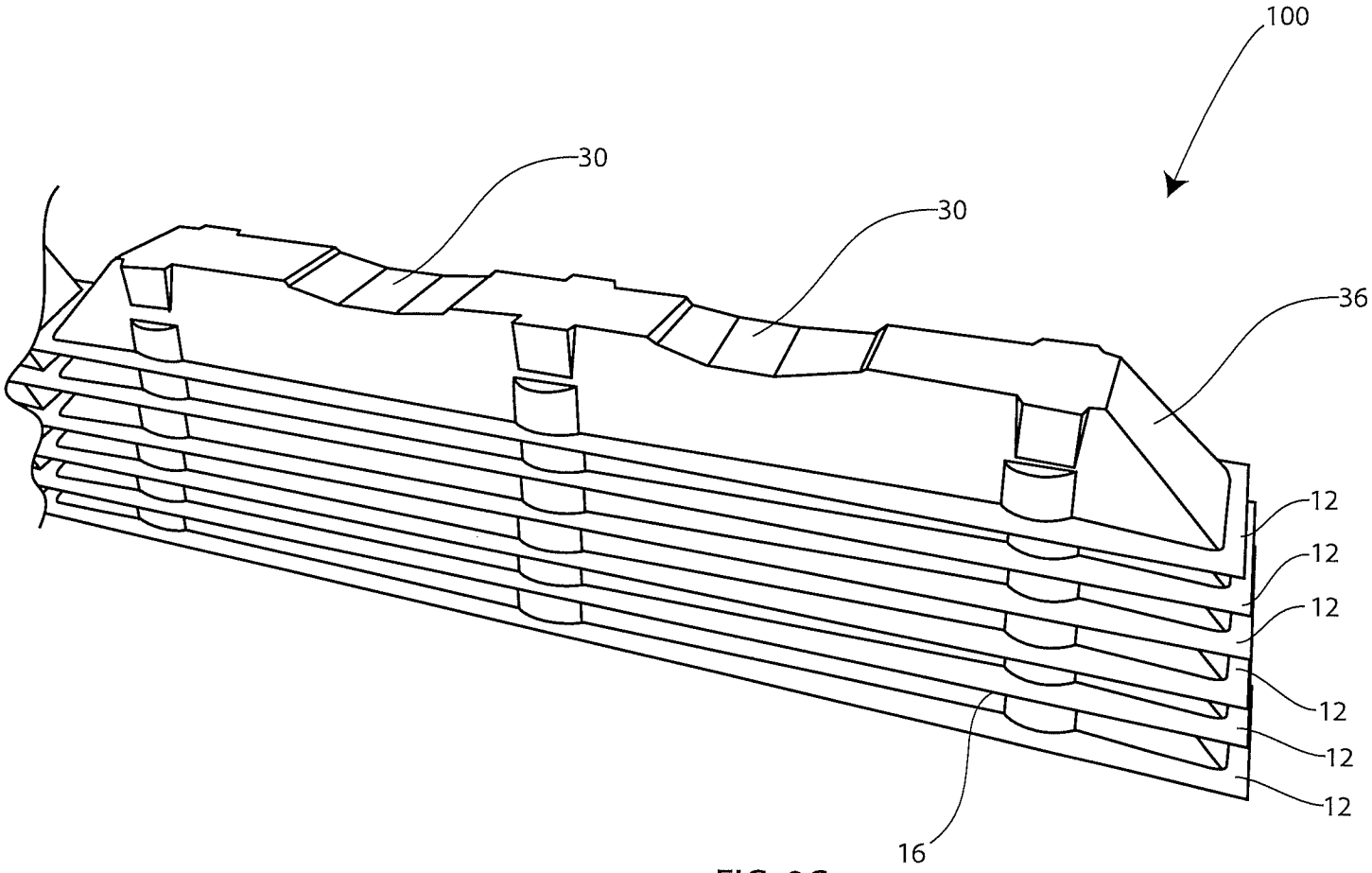
Figure 8D:
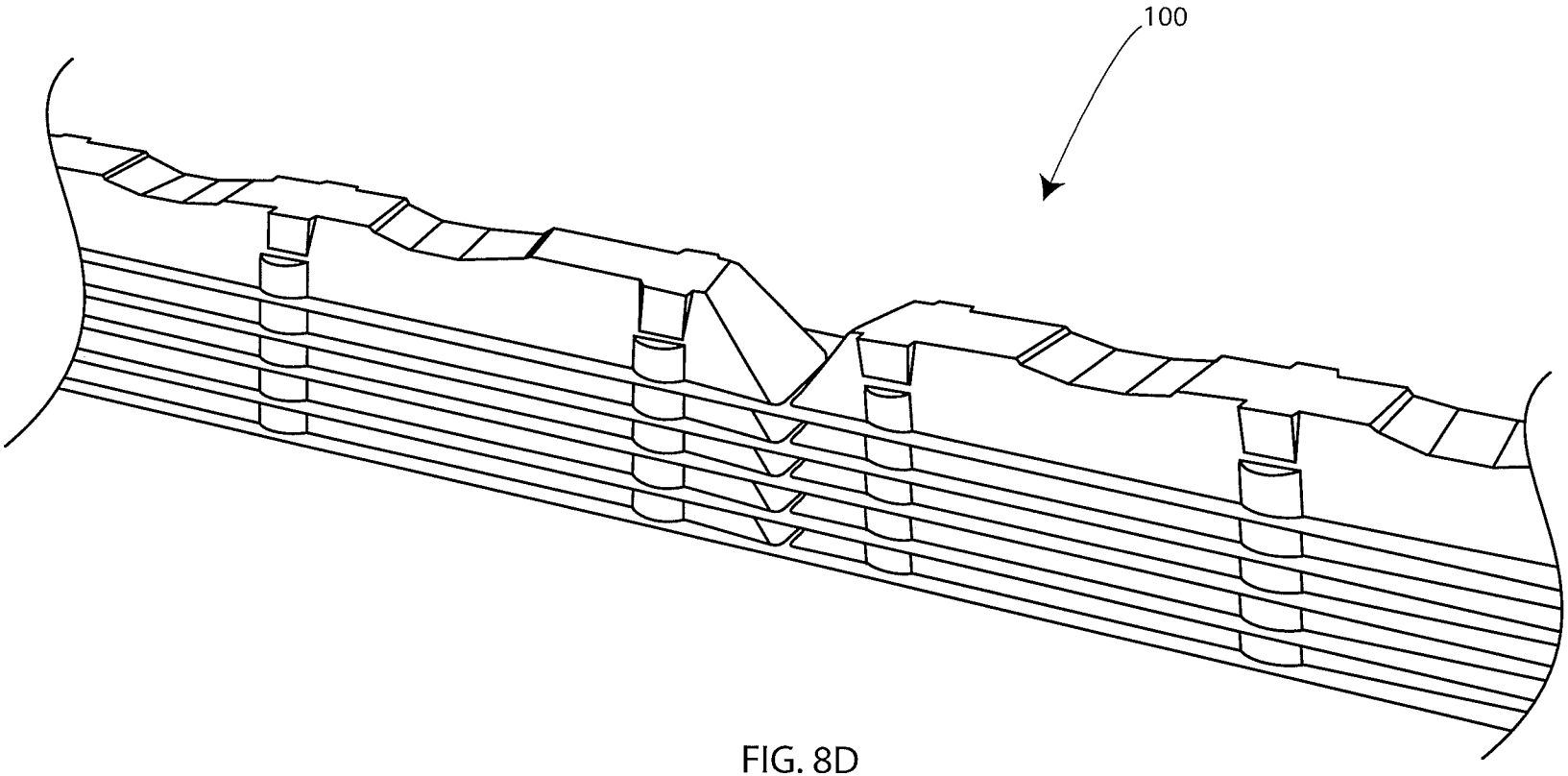

FIGS. 6D-6F show a closure strip 10 including a ledge 52. In one embodiment, a ledge 52 may project from a side of body 12. There may be a ledge 52 projecting from a first side of body 12 and also a ledge 52 projecting from a second side of body 12. It is also contemplated that ledge 52 may project inwardly into the hollow portion 18 of bottom surface 16.

In some examples, of thermoformed closure strips, ledge 52 may be manufactured with ledge 52. Ledge 52 may prevent the top surface of a recessed closure strip and the bottom surface of the closure strip from accepting the recessed closure strip from touching and potentially sticking to one another. A chamber formed between the top surface of a recessed closure strip and the bottom surface of the closure strip accepting the recessed closure strip, due to ledge 52, prevents touching and sticking during the packing, assembly and shipping of more than one recessed closure strips. In some examples, the ledge 52 may create a chamber of about 0.12"-0.18". The chamber may therefore separate the recessed closure strips from about 12"-0.18". Other dimensions for the chamber are considered within the scope of this disclosure. A portion of the ledge from the recessed closure strip may also recess into a portion of the ledge from the accepting closure strip.

In other examples, closure strips 10 may have adhesive 24 applied and be placed onto a sheet of contact paper (not shown) having a release liner. The release liner may be a silicone. The release liner allows the closure strip along with its adhesive to be removed from the contact paper. Thermoformed sheets can be coated prior to being heated and placed in a mold with a silicone. Coating the thermoformable sheet may prevent the closure strips from sticking to each other after the adhesive is applied. Contact paper may, in some instances, be eliminated during the production and usage and application of the thermoformed closure strips.

In some embodiments where there is no adhesive included with the closure strips. The closure strip may, in some instances, not include either a ledge, a chamber or a release liner. Without the ledge or the release liner, the recessed closure strips may stack directly on each other, with touching tops and bottoms and take up even less space, by stacking even more compactly. In some embodiments, a set of recessed closure strips, for example without adhesive, may be able to recess and stack at about 25 per inch. In this configuration, about 19 closure strips would fit in the space of one conventional foam type closure strip. The invention as disclosed provides a significant storage and shipping advantage over conventional closure strips.

In some examples, closure strip 10 may include a Shore A Hardness (as measured by ISO 868) at 1 second of about 79; at 5 seconds of about 75; at 15 seconds of about 74, in some embodiments in a range of about 70 to about 85, in other embodiments in a range of 74 to 79.

Other closure strip 10 examples may include a Compressive Set (73° F., 22 hours, 22% compression (ISO 815), in other examples (158° F., 22 hours, 37% compression (ISO 815)), still in other embodiments (194° F., 70 hours, 61% compression (ISO 815)).

Still in other examples, closure strip 10 may maintain its operable characteristics as discussed above in temperatures from about −40 degrees F. to about 176 degrees F.

Closure strip 10 may include a UV resistance under ASTM G154 testing at about 5000 hours with an irradiance level of 0.68 W/m2-nm, in other examples in a cycle of 8 hours at 145° F., and in other examples of 4 hours with condensation at 122° with a passing rating.

In some embodiments, strip 10 may have a Tear Strength (as measured by ASTM D624) of about 272 lbf/in, in other examples Tear Strength (ISO 34-1) of about 270 lbf/in.

Some examples of strip 10 may include a Linear Shrinkage—Dimensional Stability (as measured by ASTM 1204) that is conditioned for 6 hours in oven maintained at 176° F., Allowable change ≤0.5%, as Pass with values −0.45%×−0.20%.

Strip 10 may include a water absorption, by way of example, (as measured by ASTM D570) when immersed in water at 158° F. for 168 hours with an allowable weight change at about ≤0.5% and achieving a Pass at 2.6%. The allowable weight change in some examples, for the strip may be ≤0.5%.

FIGS. 7A-E shows examples of a system of stacked and recessed closure strips 100, for example, showing a set of at least 5 closure strips configured to be stacked and recessed.

FIGS. 8A-D shows another example of a system of stacked and recessed closure strips 100, for example, showing a set of at least 6 closure strips stacked and recessed.

Figure 9A:
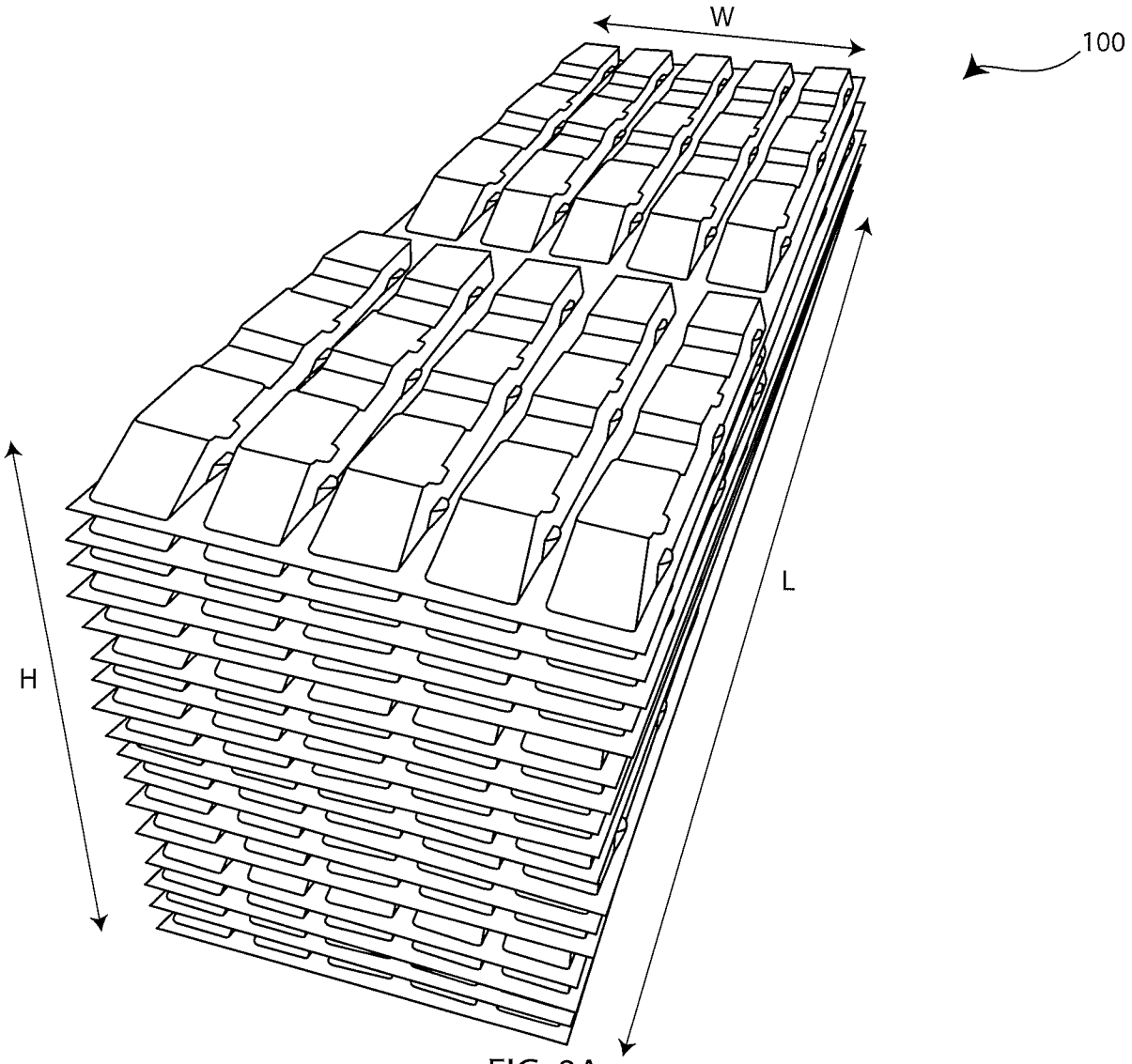
FIGS. 9A-9C are various views of stackable closure strips according to the present disclosure.
Figure 9B:
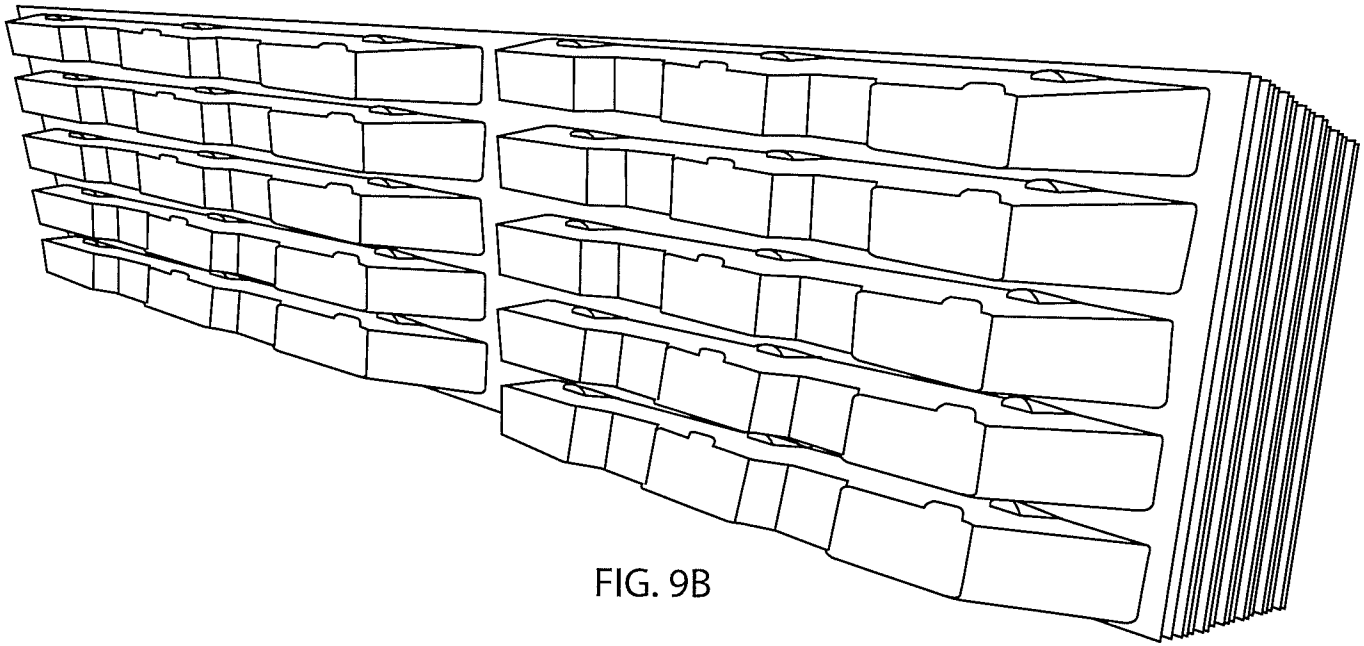
Figure 9C:
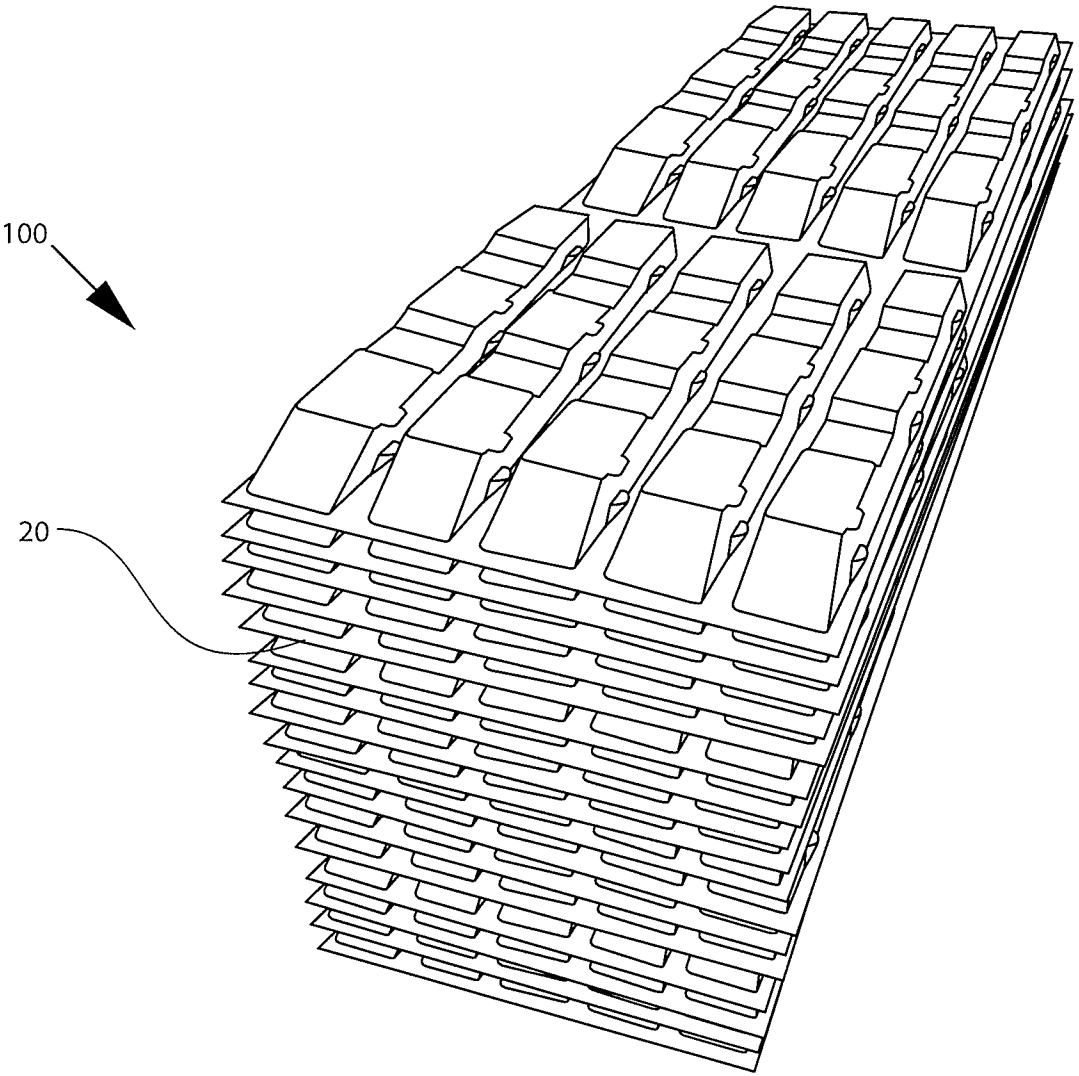

FIGS. 9A-C shows another example of a system of stacked and recessed closure strips 100, for example, showing a set of at least 27 closure strips stacked and recessed. In some examples, closure strip systems are stacked for shipping by recessing a second closure strip into a first closure strip. In some examples, sets of 100 separate closure strips may be packaged as a closure strip system and recess within one another to compact into a space to be accommodated by a packaging of about 6 inches by about 7 inches by about 36 inches. The closure strips in this example, may accommodate recessable packaging and be of structural integrity to maintain each strips individual dimensions, even when under the weight of the stacked system. In other examples, a second closure strip recessing into a first closure strip may recess at least a quarter inch into the first closure strip and at least one-half inch or more in another example. The second closure strip may substantially recess into the first closure strip such that the second closure strip, when stacked and recessed, extends beyond the first closure strip by less than 1 inch, and less than ½ inch in other embodiments, and still ½ to ¼ inches in another embodiment.

Embodiments may include a recessable closure strip system 100. The closure strips of the system 100, in this example, are able to substantially recess into one another to be stacked. The closure strips may recess such that at least three stacked closure strips are able to fit within the space of one traditional non-recessing strip. In some examples, the space is a measure of the height of the closure strip and may be referencing a height of one traditional closure strip versus the height of at least three stacked closure strips.

In some examples, a closure strip system 100 may be packaged as a kit of a plurality of closure strips configured according to any of the closure strips 10 disclosed. More than one closure strips may be assembled next to each other along a width W of the closure strips to form a kit. More than one closure strips 10 may be recessed along a height H to form a set of stacked/recessed closure strips. The kit forming a system of reduced footprint closure strips when assembled.

In some examples, the thermoformed closure strip may include a polyvinyl chloride (PVC) body. The PVC thermoformed closure strip provides the advantage of a longer life span over currently produced polyolefin closure strips. Closure strips 10 are used on metal roofing applications where temperatures during warm days can reach up to 180 degrees F. Applicant realized that a PVC closure strip will retain its physical properties better than one of polyolefins, like polyethylene, which will shrink when subjected to temperatures of around 180 degrees F. Closure strips 10, in one example, may be currently made to between about 32' to about 38", in some embodiments 36" lengths, and a problem Applicant realized with polyethylene is that it may be caused to shrink up to around 0.25" when exposed to these higher end temperatures. When the polyolefin closure strips shrink, they leave openings and fail to perform their role as an effective sealing gasket. Polyethylene will also tend to oxidize on its surface, which causes more rapid aging and degradation of the raw material, and since a PVC closure strip will not oxidize on its surface, the PVC closure strip overcomes these challenges and leads to a longer indefinite life span for the closure strip.

In some instances, an adhesive may be applied to polyolefin type closure strips so that they can be affixed in place on a roof during the installation process. Hot melt glue can be applied after the polyolefin strips are individually oriented by hand in fixtures that will then apply the adhesive from hot melt glue gun type nozzles. Alternatively, thermoformed closure strips may be molded with the strips already in the proper orientation to receive hot melt glue, without the orientation step, which reduces a significant amount of manual labor. Because the thermoformed strips are all correctly oriented and can be formed side by side during the forming process, they can be fed through a handling machine that can rapidly apply any adhesive. Another major elimination of labor occurs with the addition of an automatic feeding mechanism on the front end of the glue application machine. Additionally, a stacker on the back of the glue machine is able to speed the process and reduce unnecessary steps, labor and expense. The ability to eliminate substantial amounts of labor relative to the production of polyolefin type closure strips is possible due to the advantages of PVC thermoformed closure strips and the PVC closure strip production methods as disclosed, and recognized by Applicant.

Conventional closure strips that are currently being used in metal roofing applications are typically and necessarily colored various shades of gray, or charcoal. While a few manufactures have tried to manufacture strips using other colors, they are less common due to challenges associated with coloring of the conventional strips. As a result, foamed type polyolefin closure strips rarely match the color of the metal roof panels on which they are being installed. Applicant's thermoformed closure strips are able to be thermoformed in colors similar to the conventional closure strips, but can also be manufactured in a clear configuration, providing a transparent closure strip, not currently known in the art. A thermoformed transparent closure strip offers the advantages of being less visible when installed, which is often preferred by structure owners, and prevents the need for and the challenge of color matching of the closure strip to the roofing panel. Since roofing panel color may vary per installation, transparent closure strips overcome a significant challenge that is typically experienced with conventional closure strips.

Additionally, very few polyolefin type closure strips meet building codes that require inclusion of a level of fire retardant in the closure strip. Polyolefin type closure strips that do not meet building codes but that may have been installed create unnecessary risk for building owners. Since thermoformed closure strips of the invention are produced from raw materials like PVC that allow for inclusion of materials to meet the necessary fire retardant levels, the closure strips of the inventions as disclosed meet the standards and pass under current building codes. The level of risk that building owners often currently face is reduced with the closure strips of the disclosed inventions.

A method for sealing roofing openings on a building having a metal roof by way of a closure strip by any of the embodiments described is considered within the scope of this disclosure.

A method for a condensed footprint closure strip system by any of the embodiments described is considered within the scope of this disclosure. The condensed footprint closure strip system may include a second closure strip recessed within a first closure strip and a third closure strip recessed within the second closure strip, etc. to create a smaller footprint of a number of closure strips prepared for shipping and/or transport.

Numerous characteristics and advantages have been set forth in the foregoing description, together with details of structure and function. Many of the novel features are pointed out in the appended claims. The disclosure, however, is illustrative only, and changes may be made in detail, especially in matters of shape, size, and arrangement of parts, within the principle of the disclosure, to the full extent indicated by the broad general meaning of the terms in which the general claims are expressed. It is further noted that, as used in this application, the singular forms "a," "an," and "the" include plural referents unless expressly and unequivocally limited to one referent.

We claim:

1. A closure strip for a building having a metal roof, comprising:
- a thermally formed body,
- a top surface on one side of the body,
- a raised shelf formed in the body,
- a set of breaks in a plane along a length of the raised shelf, separating the raised shelf into a set of multiple, separated, raised shelves
- a set of angled shoulders defining each end of each of the raised shelves,
- a set of depressions in each raised shelf, wherein the set of depressions also include a set of angled shoulders extending upwardly away from the depression on each end of the depression,
- a first end and a second end at opposite ends of the body, the ends extending from the angled shoulders and terminating in the same plane as the breaks,
- a bottom surface on an opposite side of the body from the top surface, and
- a hollow portion in the bottom surface.

2. The closure strip of claim 1 wherein the body is formed of a thermoplastic resin.

3. The closure strip of claim 2 wherein the thermoplastic resin is polyvinyl chloride.

4. The closure strip of claim 1 wherein the thermally formed body is transparent.

5. The closure strip of claim 1 wherein the thermally formed body is formed of a clear raw material.

6. The closure strip of claim 4 wherein the closure strip is configured to conform to a ¾" metal roofing panel profile.

7. The closure strip of claim 1 including an adhesive on the top surface.

8. The closure strip of claim 1 including an ultraviolet inhibiting additive for enhancing the lifespan of the closure strip.

9. The closure strip of claim 8 wherein the strip includes a fire retardant additive.

10. The closure strip of claim 9 wherein the closure strip is made of a recyclable material.

11. The closure strip of claim 1 wherein a bottom face of the depressions are closer to a top surface of the raised shelf than a bottom face of a break.

12. The closure strip of claim 11 including two or more depressions between each break.

13. The closure strip of claim 1 configured to be assembled on a roof end-to-end with a second closure strip.

14. The closure strip of claim 13 including at least one ledge.

15. A closure strip system for a building having a metal roof, comprising:
- a first closure strip and a second closure strip included in a set of closure strips, at least the first and second closure strip recessable into one another and including,
  - a thermally formed body,
  - a top surface on one side of the body, the top surface including a raised shelf extending above a plane of a set of breaks between portions of the raised shelf, the breaks dividing the raised shelf into a set of separated shelves, the raised shelf having an extended linear surface including a set of depressions in the raised shelf with the set of depressions defined on each end by a set of angled shoulders, a first end and a second end at opposite ends of the body, the ends extending from a lower end of the angled shoulders and terminating in the same plane as the breaks, a bottom surface on an opposite side of the body from the top surface, and a hollow portion in the bottom surface configured to accept another closure strip recessed into the hollow portion, wherein two or more closure strips align along linear top sections in the hollow portion.

16. The system of claim 15 including a chamber formed between the top surface of the first closure strip and the bottom surface of a second closure strip when the first closure strip and the second closure strip are nestled one into the other.

17. The system of claim 16 wherein the top surface includes a raised shelf.

18. The system of claim 17 wherein the hollow portion of the first closure strip is configured to accept the raised shelf of the second closure strip.

19. The system of claim 18 wherein the closure strips are recessed one within another to achieve greater than 10 recessed closure strips stacked per inch.

20. A kit for sealing roofing openings on a building having a metal roof by way of a recessable closure strip system, comprising:

a plurality of closure strips including at least a first closure strip and a second closure strip, the first closure strip having a set of major ribs and a hollowed portion, the second closure strip having a set of major ribs and a hollowed portion, wherein said major ribs are separated by breaks and the major ribs include more than one depression surrounded by angled shoulders, with an end of each closure strip terminating with one of the breaks, wherein said second closure strip recesses into the hollowed portion of said first closure strip and said recessed closure strips separate from one another for installation between a building and a metal roof.

* * * * *